US007976378B2

(12) United States Patent
Baerlocher

(10) Patent No.: US 7,976,378 B2
(45) Date of Patent: Jul. 12, 2011

(54) GAMING DEVICE HAVING ODDS OF WINNING WHICH INCREASE AS A PLAYER'S WAGER INCREASES

(75) Inventor: Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 345 days.

(21) Appl. No.: 12/101,695

(22) Filed: Apr. 11, 2008

(65) Prior Publication Data

US 2008/0194316 A1 Aug. 14, 2008

Related U.S. Application Data

(60) Division of application No. 11/242,157, filed on Oct. 3, 2005, now Pat. No. 7,374,486, which is a continuation of application No. 09/687,691, filed on Oct. 13, 2000, now Pat. No. 7,029,395.

(51) Int. Cl.
*A63F 9/24* (2006.01)

(52) U.S. Cl. ..... 463/20

(58) Field of Classification Search ..... 463/20
See application file for complete search history.

(56) References Cited

U.S. PATENT DOCUMENTS 4,448,419 A * 5/1984 Telnaes ..... 463/21
4,582,324 A 4/1986 Koza et al.
4,991,848 A 2/1991 Greenwood et al.
5,116,055 A 5/1992 Tracy
5,123,649 A 6/1992 Tiberio
5,178,390 A 1/1993 Okada
5,280,909 A 1/1994 Tracy
5,286,023 A 2/1994 Wood
5,344,144 A 9/1994 Canon
5,380,007 A 1/1995 Travis et al.
5,524,888 A 6/1996 Heidel
5,536,016 A 7/1996 Thompson
5,542,669 A 8/1996 Charron et al.

(Continued)

FOREIGN PATENT DOCUMENTS

AU 758306 8/1998

(Continued)

OTHER PUBLICATIONS

Marshall Fey, Slot Machines, A pictorial History of the First 100 Years, 1983, Liberty Belle Books, p. 88.*

(Continued)

*Primary Examiner* — Corbett B Coburn
(74) *Attorney, Agent, or Firm* — K&L Gates LLP

(57) ABSTRACT

A gaming device having a game which requires the same average investment from a player to win an award, including a jackpot award, regardless of the amount that the player bets at any one time. The award can be unchanging, e.g., $10,000, each time a player plays the gaming device. The award can also vary such as with a progressive jackpot, i.e., the jackpot builds unfit a player "hits" the jackpot. The game enables the average investment necessary to win the jackpot to be uniform by varying the odds of winning the jackpot as the player's bet varies. That is, a player betting less money needs to play the game more times, on average, to win the jackpot. Likewise, a player betting more money needs to play the game less times, on average, to win the jackpot. The average overall bet or investment thus remains constant despite the player's betting habits or betting ability.

8 Claims, 16 Drawing Sheets

U.S. PATENT DOCUMENTS

| | | | | |
|---|---|---|---|---|
| 5,551,692 | A | 9/1996 | Pettit et al. | |
| 5,611,730 | A | 3/1997 | Weiss | |
| 5,645,486 | A | 7/1997 | Nagao et al. | |
| 5,709,603 | A | 1/1998 | Kaye | |
| 5,711,525 | A | 1/1998 | Breeding | |
| 5,788,573 | A | 8/1998 | Baerlocher | |
| 5,807,172 | A | 9/1998 | Piechowiak | |
| 5,833,538 | A | 11/1998 | Weiss | |
| 5,902,184 | A | 5/1999 | Bennett et al. | |
| 5,910,048 | A | 6/1999 | Feinberg | |
| 5,941,773 | A | 8/1999 | Harlick | |
| 5,947,820 | A | 9/1999 | Morro et al. | |
| 5,967,894 | A | 10/1999 | Kinoshita et al. | |
| 5,980,384 | A | 11/1999 | Barrie | |
| 5,997,401 | A | 12/1999 | Crawford | |
| 6,012,982 | A | 1/2000 | Piechowiak et al. | |
| 6,033,307 | A | 3/2000 | Vancura | |
| 6,059,289 | A | 5/2000 | Vancura | |
| 6,110,041 | A | 8/2000 | Walker et al. | |
| 6,110,043 | A | 8/2000 | Olsen | |
| 6,117,012 | A | 9/2000 | McCrea, Jr. | |
| 6,129,632 | A | 10/2000 | Luciano | |
| 6,146,273 | A | 11/2000 | Olsen | |
| 6,155,925 | A | 12/2000 | Giobbi et al. | |
| 6,159,097 | A | 12/2000 | Gura | |
| 6,159,098 | A | 12/2000 | Slominary et al. | |
| 6,162,122 | A | 12/2000 | Acres et al. | |
| 6,174,233 | B1 | 1/2001 | Sunaga et al. | |
| 6,186,894 | B1 * | 2/2001 | Mayeroff | 463/20 |
| 6,224,483 | B1 | 5/2001 | Mayeroff | |
| 6,241,608 | B1 | 6/2001 | Torango | |
| 6,244,957 | B1 | 6/2001 | Walker et al. | |
| 6,322,445 | B1 | 11/2001 | Miller | |
| 6,334,612 | B1 | 1/2002 | Wurz et al. | |
| 6,435,968 | B1 | 8/2002 | Torango | |
| 6,537,150 | B1 * | 3/2003 | Luciano et al. | 463/16 |
| 6,592,460 | B2 | 7/2003 | Torango | |
| 2002/0042297 | A1 | 4/2002 | Torango | |
| 2003/0060279 | A1 | 3/2003 | Torango | |
| 2004/0009811 | A1 | 1/2004 | Torango | |
| 2005/0119047 | A1 | 6/2005 | Olive | |
| 2005/0143168 | A1 | 6/2005 | Torango | |
| 2005/0176488 | A1 | 8/2005 | Olive | |
| 2005/0209004 | A1 | 9/2005 | Torango | |

FOREIGN PATENT DOCUMENTS

| | | |
|---|---|---|
| AU | 754689 | 2/1999 |
| AU | 199884162 | 3/1999 |
| DE | 44 17 458 | 11/1995 |
| WO | WO 00/32286 | 6/2000 |

OTHER PUBLICATIONS

Fey, Marshall, Slot Machines, A Pictorial History of the First 100 Years, 1983, Liberty Bell Books, pp. 19, 43, 213.

Jackpot Bingo Description, Casino Data Systems (CDS.com), Printed on Apr. 12, 2001.

Megabucks Brochure, IGT, 1998.

Power Ball Lottery Odds & FAQ, http://www.musl.com, available at least as early as Jul. 11, 2002.

Slot Machines on Parade by Geddes et al., The Mead Company, 1980, pp. 127 & 192.

The Theory of Gambling and Statistical Logic by Epstein, 1977, pp. 117-118.

Vegas Girl Brochure, IGT, available prior to Oct. 13, 2000.

Video Wheel of Fortune Brochure, IGT, 1999.

* cited by examiner

FIG.11

| | GAME 1 | GAME 2 | GAME 3 | GAME 4 | GAME 5 | GAME 6 |
|---|---|---|---|---|---|---|
| BASE GAME ODDS 112 | Δ ODDS AS f(Δ BET) | Δ ODDS AS f(Δ #PAYLINES) | Δ ODDS AS f(Δ #PAYLINES) | Δ ODDS AS f(Δ $/PAYLINES) | Δ ODDS AS f(Δ #PAYLINES) | ODDS CONSTANT 130 |
| FIRST BONUS LEVEL ODDS 114 | | X | X | X | X | X |
| | | Δ ODDS AS f(Δ $/PAYLINES) | Δ ODDS AS f(Δ $/PAYLINES) | Δ ODDS AS f(Δ #PAYLINES) | ODDS CONSTANT 130 | ODDS AS f(Δ #PAYLINES) |
| SECOND BONUS LEVEL ODDS 116 | | | | | X | X |
| | | | | | Δ ODDS AS f(Δ $/PAYLINES) | Δ ODDS AS f(Δ $/PAYLINES) |

GAMING DEVICE HAVING ODDS OF WINNING WHICH INCREASE AS A PLAYER'S WAGER INCREASES

PRIORITY CLAIM

This application is a divisional application of U.S. patent application Ser. No. 11/242,157, filed Oct. 3, 2005, which claims priority to and the benefit of U.S. patent application Ser. No. 09/687,691, filed Oct. 13, 2000, now issued U.S. Pat. No. 7,029,395, the entire contents of which are incorporated herein.

CROSS REFERENCE TO RELATED APPLICATIONS

This application relates to the following co-pending commonly owned patent applications: "GAMING DEVICE HAVING ODDS OF WINNING WHICH INCREASE AS A PLAYER'S WAGER INCREASES," Ser. No. 12/102,308; "GAMING DEVICE HAVING ODDS OF WINNING WHICH INCREASE AS A PLAYER'S WAGER INCREASES," Ser. No. 12/101,663; "GAMING DEVICE HAVING ODDS OF WINNING WHICH INCREASE AS A PLAYER'S WAGER INCREASES," Ser. No. 12/101,709; and "GAMING DEVICE HAVING ODDS OF WINNING WHICH INCREASE AS A PLAYER'S WAGER INCREASES," Ser. No. 12/102,251.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having an award including a jackpot award, wherein the average investment required to win the award is the same regardless of the amount of a player's bet.

BACKGROUND

It is well known to provide gaming devices having a certain average percentage payback to the player. Slot gaming machines typically predetermine the payback percentage to be around 90%, or 90 cents on the dollar. When slot gaming machines include progressive jackpots, the payback percentage of the machine can increase towards 100%.

Progressive slot machines contain jackpots that increase every time a player plays the slot machine. A linked progressive includes two or more slot machines connected to a common jackpot, each of which individually contribute to the jackpot. An individual progressive slot machine has a self-contained jackpot, wherein the jackpot grows with every play. The machines usually take a percentage of the players bet such as 10%, and add it to the jackpot. The jackpots can reach sizeable amounts, e.g., $1 million, before a player "hits" or wins the jackpot. Such sizeable jackpots become very attractive to players. Furthermore, as the jackpot grows, so does overall payout percentage of the game.

Regardless of the type of progressive, known games typically require the player to play the maximum bet to be eligible to win the progressive jackpot. Even on a single payline dollar machine, the maximum bet can be $5 (max bet on most slot machines is 5 credits per payline). Many players who are not willing to wager such an amount, or consistently willing to wager such an such an amount, are thus excluded from having an opportunity to win the progressive jackpot and enjoy its associated payout increase. A known progressive slot machine that requires a max bet to enable the player to win a jackpot includes a "Megabucks" game by IGT, the assignee of this invention.

Other known multi-payline slot machines enable the player to win a predetermined, i.e., fixed, jackpot when the player plays or activates all the paylines of the gaming device. A payline is a series of adjacent or juxtaposed symbols that the game analyzes to determine if the prayer has won or lost a game of the slot machine. On a machine displaying five reels and three symbols per reel, it is not uncommon for the machine to have five, nine or fifteen different paylines. The machines commonly enable a player to wager up to $5 on one or more paylines. The machines usually require the player to bet the lines sequentially, i.e., one, two, three as opposed to one, three, eight, and most machines require the same bet to be placed on each line. On a $1 machine, the player may again have to wager at least $5 to play each of the five lines to be eligible for a jackpot. Many players are again unwilling and thus excluded from having an opportunity to win a multi-payline jackpot and enjoy its associated payout increase. A known slot machine that requires a player to bet all paylines to enable the player to win a progressive jackpot includes a "Jackpot Bingo" game by Casino Data Systems. "Jackpot Bingo" also offers different jackpots if the player bets a second dollar on each line and plays the maximum number of lines. This game therefore offers two different jackpots: one for a $1 bet per line and a larger one for a $2 bet per line.

Other slot machines require the player to wager the max bet, i.e., the highest possible number of credits on each of the paylines, or max lines, i.e. at least one coin per payline before the game enables the player to win a predetermined award from a game of the gaming device. A known slot machine that requires a player to wager a max bet to enable the player to win an award includes a "Video Wheel of Fortune" game by IGT. In each of these situations, it is desirable to provide a gaming device having a game that enables any player to be eligible to win the award and enjoy its associated payout increase, regardless of the amount wagered.

Another drawback to known jackpots including progressive jackpots is that once enabled, if the players bet exceeds the threshold level necessary to enable the jackpot, the known games do not reward the player for exceeding the threshold. These types of games provide the same jackpot award with the same odds of winning the jackpot regardless of whether the player plays 1 or 5 credits per payline. This creates a disincentive to bet more coins since the payback percentage decreases as the player's wager increases. For example, a "Tropical Link" game by Aristocrat Technologies, Inc. activates a jackpot award when any of the paylines are played but does not reward the player for wagering multiple coins or credits on a payline.

There exists at least one known slot machine that increases the player's odds of winning a jackpot based upon the number of coins or credits played. Another Aristocrat game called "Hyperlink" maintains a system separate and apart from the normal operation of the game of the slot machine for adjusting the odds based upon the amount of the players wager. In the Aristocrat system, the system makes a separate evaluation based solely on the number of coins wagered by the player to determine whether the player is eligible to win a jackpot. The game makes the separate evaluation completely independent of the events of the game play. Gaming device play does not determine whether the game awards a jackpot; rather, a system connected to the game makes this determination.

For example, in the Aristocrat system, if the player bets one coin, the Aristocrat system can maintain a 1/10,000 chance of making the player eligible to play for the jackpot, whereby if the player bets forty-five coins, the Aristocrat system would then maintain a 45/10,000 chance of making the player eligible for the Jackpot. This machine, however, does not employ a game that the player sees and/or plays that sets forth, employs or carries out the determination using the odds dictated by the amount of the player's wager.

SUMMARY

The present invention provides a gaming device and preferably a bonus round of a gaming device, wherein the game requires the same average investment from a player to win an award or jackpot from the gaming device, regardless of the amount that the player bets at any one time. The award or jackpot can be unchanging, e.g., $10,000, each time a player plays the gaming device. The jackpot can also be progressive, i.e., the jackpot builds until a player "hits" the jackpot, after which the progressive jackpot starts from a predetermined minimum and builds again.

The game enables the average investment necessary to win the jackpot to be uniform by varying the odds of winning the jackpot as the amount of the players bet varies. That is, a player betting less money needs to play the game more times, on average, to win the jackpot. Likewise, a player betting more money needs to play the game less times, on average, to win the jackpot. The average overall bet or investment thus remains constant despite the player's betting habits or betting ability. The game enables the player playing the smallest possible gaming device wager to have a chance at winning the jackpot. At the same time, the game does not punish the higher stakes player; but rather, increases the likelihood of winning or provides more favorable odds as the player increases the total bet or wager or an individual component of the wager such as each bet on a payline.

It should be appreciated that although the average investment necessary to win the jackpot does not vary, the jackpot itself does not have to remain constant, such as in the progressive game described above. The return on investment, which is a function of the jackpot amount divided by the average total necessary investment can thus vary over time or upon playing different turns of the gaming device. Such a change of return on investment, however, applies equally to small stakes as well as large stakes players. The return on investment as a function of time or event can therefore vary. However, the return on investment, at one time or upon one event, as a function of the amount of a player's wager (including components of the player's total wager), is constant.

The present invention applies to any type of gaming device, wherein a player bets or wagers an amount of money (in whole or in components), and the game pays back a certain average percentage of money to the player. The present invention more particularly applies to a slot machine gaming device, which usually has three to five symbol generating reels, displays three symbols per reel and maintains one to fifteen different paylines (each bet on a payline being a component of the total wager).

When the gaming device of the present invention is a slot machine, there exists two well known and standard components to the players total bet or wager; namely, (i) the number of paylines that a player has bet and (ii) the players bet per active payline. Increasing the likelihood that a player will win at a slot machine as the player increases the total bet via increasing the number of paylines, when the winning symbols or combinations remain constant, is well known and is, in fact, one of the purposes of employing multiple paylines. The present invention, however, contemplates changing the winning symbols or combinations and thereby providing more favorable odds when the player plays more paylines. The present invention also contemplates increasing the likelihood that a player will win at a slot machine as the player increases the total bet via increasing the bet per active payline. The present invention further contemplates increasing the likelihood that a player will win at a slot machine as the player increases the total bet via increasing the paylines and the bet per active payline. For purposes of this application, a "wager component" includes but is not limited to a payline.

In the present invention, the number of paylines bet and the bet per active payline are player inputs that the gaming device has no control over, but which form an overall bet and dictate to the gaming device the odds of the player winning a jackpot prize. The gaming device must in turn have one or more methods to vary the odds based upon the overall bet. The present invention contemplates a plurality of different methods for varying the odds based upon the overall bet. The present invention can employ one or more methods for varying the odds based upon the number of paylines bet. The present invention can employ one or more methods for varying the odds based upon the bet per active payline. The present invention can also employ a combination of these methods.

In one embodiment, the game controls the odds created by a player selecting a number of paylines by enabling a player betting more paylines to have better odds at reaching a bonus round or jackpot game, wherein the bonus round or jackpot game enables the player to play for the jackpot prize. The players odds are better because the player can win a jackpot on any wagered payline. In another embodiment, the game controls the odds created by a player selecting a bet per payline by enabling a player betting a higher number of credits per payline to have more chances in the jackpot game and thus better odds at winning the jackpot game. It should be appreciated that the present invention can then combine these two methods, so both the paylines and bet per activated payline affect the odds for the player.

It should be appreciated that the present invention includes increasing the odds of a win as the player increases the wager by other suitable means, such as increasing the number of reel spins related to the wager as the wager increases. By increasing the spins or chances, the chance of winning increases.

The game also contemplates a plurality of player interactive events for each method contemplated by the present invention. One player interactive event contemplated by the present invention for controlling the odds of entering the bonus round or jackpot game in accordance with the number of paylines played includes predetermining one or more symbols or combinations thereof on the reels of the gaming device to enable the bonus round. The game can then distribute the enabling symbols on the reels such that a player playing more paylines will have a better likelihood or odds of entering the bonus round or jackpot game. One player interactive event contemplated by the present invention for controlling the odds of the player winning the jackpot once the player reaches the bonus round or jackpot game includes: (i) a random symbol generation device having one or more jackpot symbols; (ii) a requirement that the player obtain a predetermined number of said jackpot symbols to win the jackpot; and (iii) a number of chances for the player to randomly generate a jackpot symbol, said number increasing as the bet per line or overall bet increases.

It is therefore an object of the present invention to provide a gaming device with an award, wherein the players odds of winning the award via a player interactive event increase as the player's wager increases.

Another object of the present invention is to provide a gaming device with a jackpot award provided as an outcome of a player interactive event, wherein the player's return on investment is independent of the amount of the player's wager.

A further object of the present invention is to provide a slot machine gaming device with an award, wherein the odds of winning said award via a player interactive event increase as a players bet per payline increases.

Yet another object of the present invention is to provide a slot machine gaming device with an award, wherein the odds of winning said award via a player interactive event increase as a player's number of active paylines and bet per payline increases.

Other objects, features and advantages of the invention will be apparent from the following detailed disclosure, taken in conjunction with the accompanying sheets of drawings, wherein like numerals refer to like parts, elements, components, steps and processes.

Additional features and advantages are described herein, and will be apparent from, the following Detailed Description and the figures.

BRIEF DESCRIPTION OF THE FIGURES

FIG. 11 is a schematic chart illustrating a plurality of possible games of the present invention, wherein each has a separate odds varying method involving one or more of the wager components (number of paylines and/or bet per payline), and one or more of gaming device components (base game and/or bonus game);

DETAILED DESCRIPTION

Gaming Device and Electronics

Figure 1A:
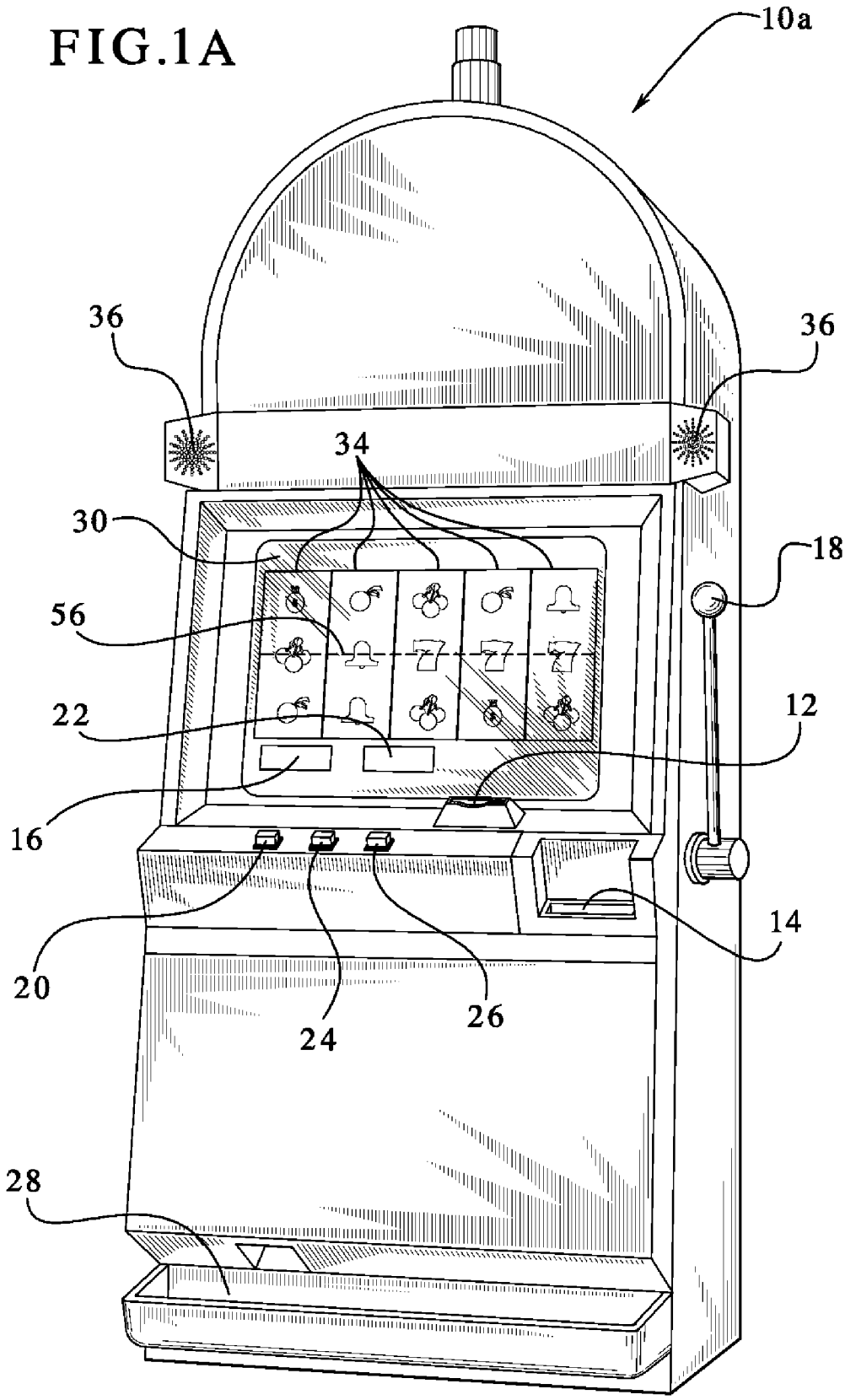
FIG. 1A is a front-right side perspective view of one embodiment of the gaming device of the present invention.
Figure 1B:
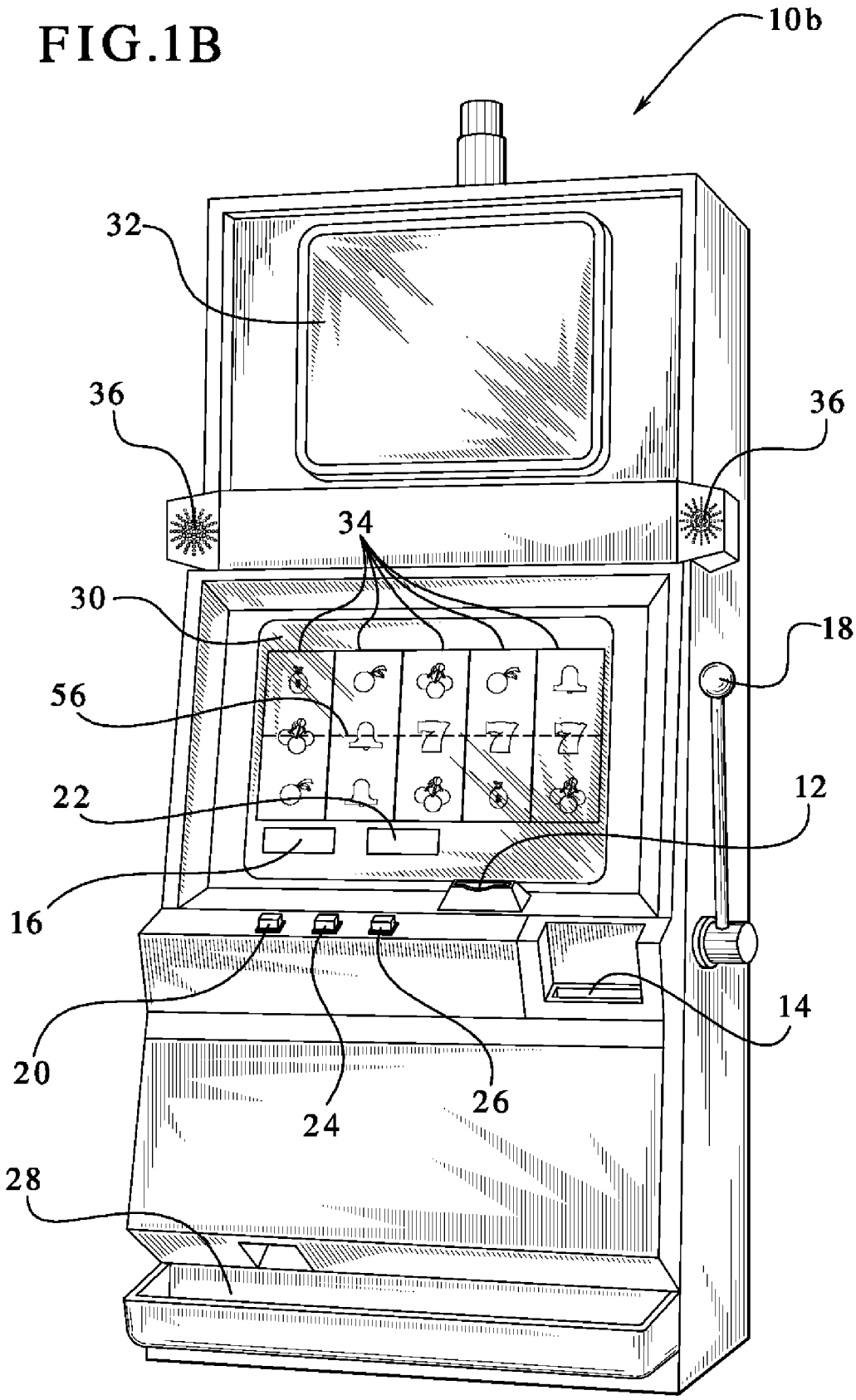
FIG. 1B is a front-right side perspective view of another embodiment of the gaming device of the present invention.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is preferably a slot machine having the controls, displays and features of a conventional slot machine. It is constructed so that a player can operate it while standing or sitting, and gaming device 10 is preferably mounted on a console. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker or keno, any of their bonus triggering events and any of their bonus round games. The symbols and indicia used on and in gaming device 10 may be in mechanical, electrical or video form.

Figure 18:
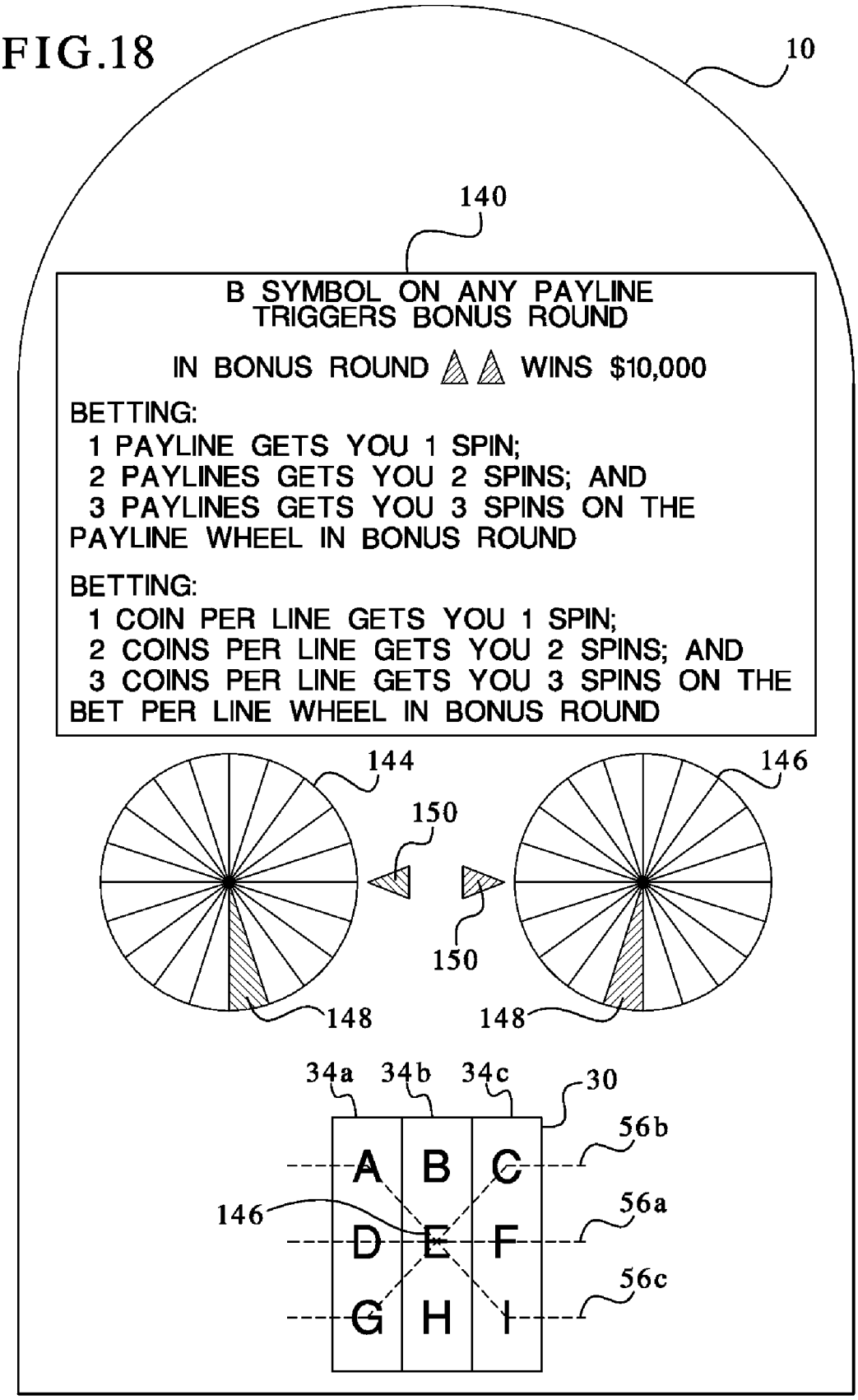
FIG. 18 is a front plan view of a portion of the gaming device which includes the apparatus necessary to carry out the method of Game 6 of FIG. 11, wherein the present invention provides an odds constant in the base game and varies the odds in the bonus round.

As illustrated in FIGS. 1A and 18, gaming device 10 includes a coin slot 12 and bill acceptor 14 where the player inserts money, coins or tokens. The player can place coins in the coin slot 12 or paper money or a ticket voucher in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

At any time during the game, a player may 'cash out' and thereby receive a number of coins corresponding to the number of remaining credits by pushing a cash out button 26. When the player "cashes out," the player receives the coins in a coin payout tray 28. The gaming device 10 may employ other payout mechanisms such as credit vouchers redeemable by a cashier or electronically recordable cards which keep track of the player's credits.

Gaming device 10 also includes one or more display devices. The embodiment shown in FIG. 1A includes a central display device 30, and the alternative embodiment shown in FIG. 1B includes a central display device 30 as weal as an upper display device 32. Gaming device 10 preferably displays a plurality of reels 34, preferably three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other static or dynamic display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
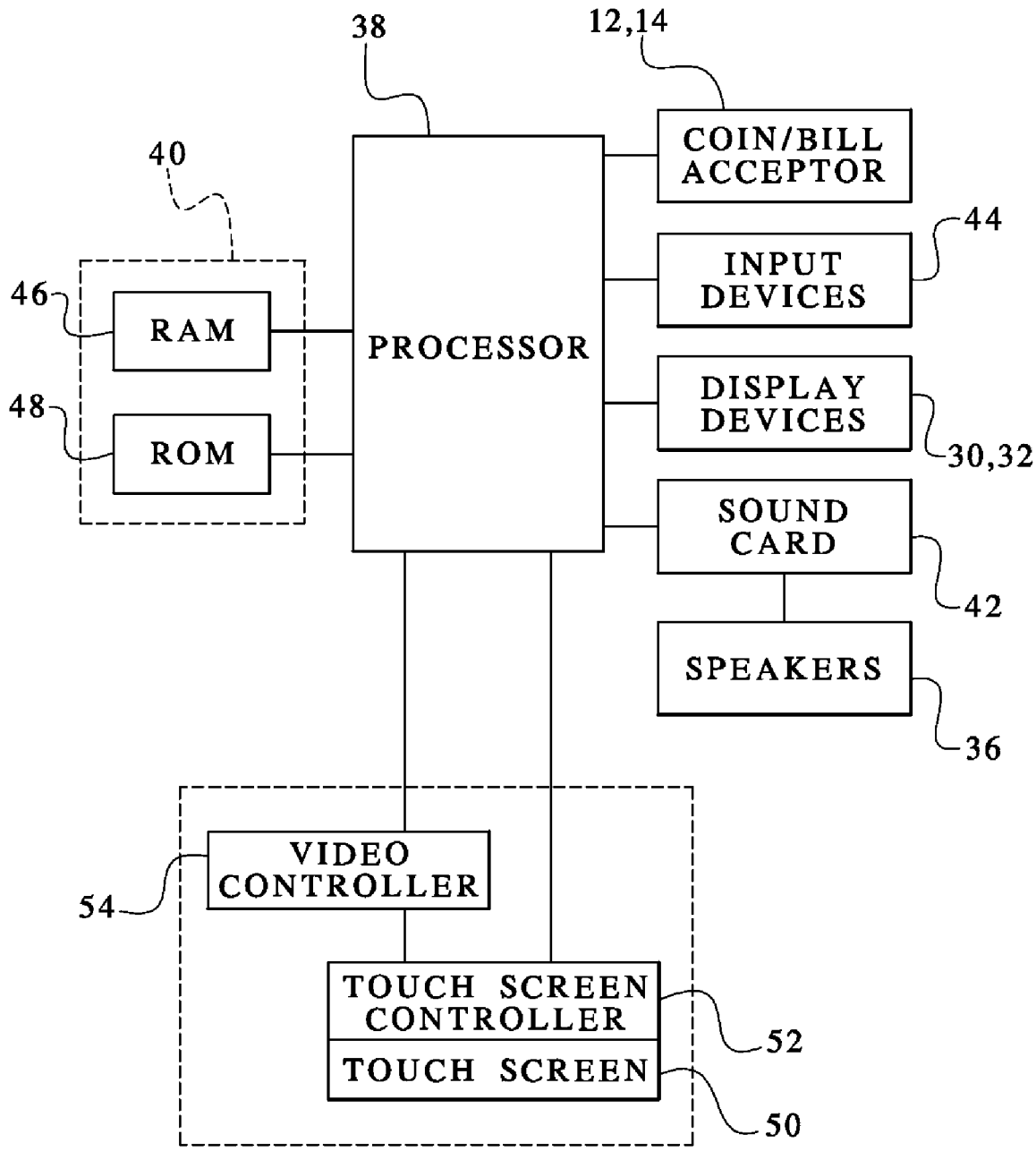
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data, a central display device 30; an upper display device 32; a sound card 42, a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processors"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the 'computer' or "controller."

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 preferably uses a video-based central display device 30 to enable the player to play the bonus round. Preferably, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

Examples of the Present Invention

To best understand the present invention, it is easiest to illustrate different examples, wherein certain examples illustrate known gaming devices and certain examples illustrate the gaming device of the present invention. A first set of examples includes the following parameters; (i) a wager x, which can vary but which will be illustrated within the range of $1 to $45; (ii) a jackpot award % y, which is equal to $10,000; (iii) a payout ratio z, which is a constant for the present invention and which undesirably varies in known gaming machines.

The present invention applies the following mathematical formula in determining the players odds as a function of the player's wager:

$$\text{odds}=y/(x*z).$$

Assuming that on average, $100,000 is wagered for every jackpot it pays out, z, which is constant in the present invention, equals $10,000 (the jackpot)/$100,000 (the take)=0.1. Plugging 0.1 into the payout ratio z of the above equation and inputting different values for the player's wager x yields the following odds:

If player wagers $1 the odds of winning the jackpot are 100,000:1;

If player wagers $2, the odds of winning the jackpot are 50,000:1;

If player wagers $3, the odds of winning the jackpot are 33,333:1;

If player wagers $4, the odds of winning the jackpot are 25,000:1;

If player wagers $5, the odds of winning the jackpot are 20,000:1;

If player wagers $6, the odds of winning the jackpot are 16,666:1;

If player wagers $7, the odds of winning the jackpot are 14,285:1;

If player wagers $8, the odds of winning the jackpot are 12,500:1;

If player wagers $9, the odds of winning the jackpot are 11,111:1; and

If player wagers $10, the odds of winning the jackpot are 10,000:1.

Figure 3:
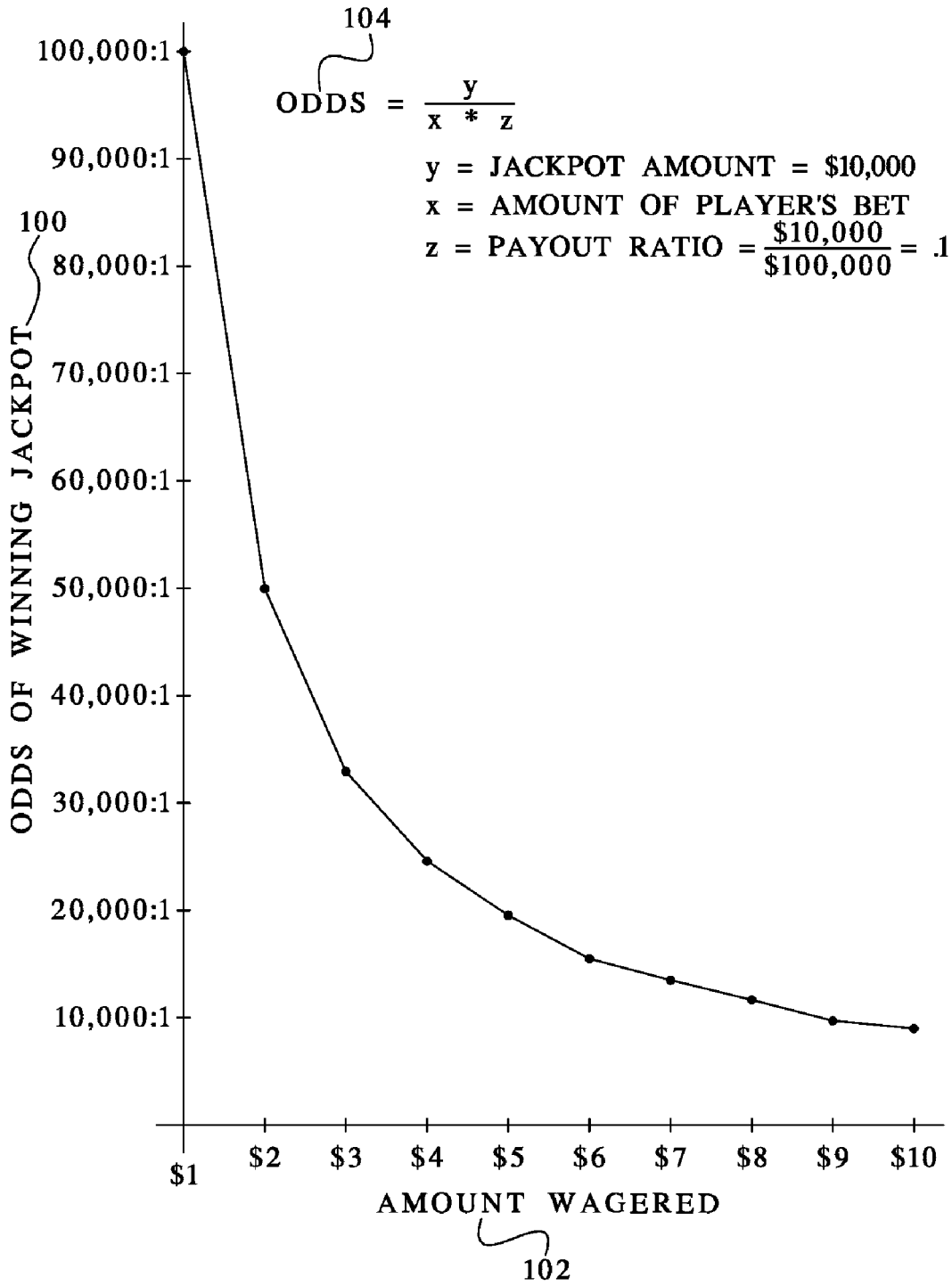
FIG. 3 is a graph illustrating a curve of the odds as a function of the amount wagered for the present invention.

Referring now to FIG. 3, a graph illustrates a curve of the odds as a function of a player's bet for the present invention. The graph includes the odds of winning the jackpot 100 along the y-axis of the graph and the amount wagered or player's bet 102 along the x-axis of the graph. The graph also includes the odds equation 104 described above and a definition of its constituents x, y, and z. The graph illustrates that the players bet 102 affects the players odds of winning the jackpot 100. Betting $2 instead of $1 doubles the likelihood of winning the jackpot. Betting $5 instead of $1 makes the player five times as likely to win the jackpot, and so on. Every change in wager results in a change of odds. Every increase in wager results in more favorable odds for the player.

Figure 4:
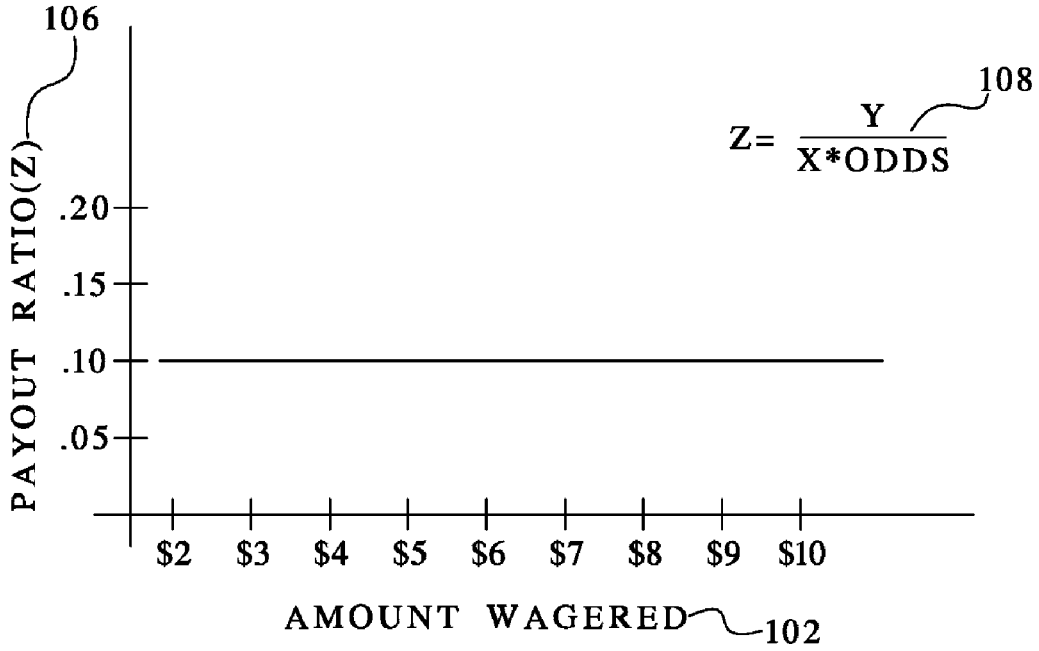
FIG. 4 is a graph illustrating a plot of the payout ratio as a function of the amount wagered for the present invention.

Referring now to FIG. 4, a graph illustrates a plot of the payout ratio as a function of the amount wagered or players bet for the present invention. The graph includes the payout ratio, z, 106 along the y-axis and amount wagered 102 along the x-axis. The graph also includes a payout ratio equation 108 including the constituents x, y, and odds. The straight horizontal line indicates that the payout ratio z of the present invention is constant regardless of the amount wagered. The game pays the same percentage regardless of how much the player wagers. The present invention thus enables any type of player, low stakes or high stakes, to have an opportunity to win the jackpot y. Players wilting to wager large amounts, however, will enjoy more favorable odds of winning the jackpot.

Referring to both FIGS. 3 and 4, it should be appreciated that the odds curve of FIG. 3 and the payout ratio line of FIG. 4 for the present invention do not require the jackpot y to have any particular value. In the example the jackpot is $10,000, however, the jackpot can have any value, e.g., $10, $100, $1,000, $100,000: $1,000,000 etc. The jackpot y can also vary over time or as a function of a gaming device event, i.e., from game to game. For example, on one spin of the reels 34 (FIGS. 1A and 1B), the jackpot can be $5,000 and on the next spin the jackpot can be $15,000, etc. The graphs of FIGS. 3 and 4 apply to one spin of the reels or one turn at the gaming device. Within one spin or turn, the odds at winning a particular jackpot are better the more a player wagers, but the payout ratio for that particular jackpot is the same despite the amount wagered. The present invention thus includes progressive games described above. Even if a particular progressive jackpot increases white the reels of a slot machine are spinning, the present invention stilt applies to whatever value is ultimately available for the player to win.

Figure 5:
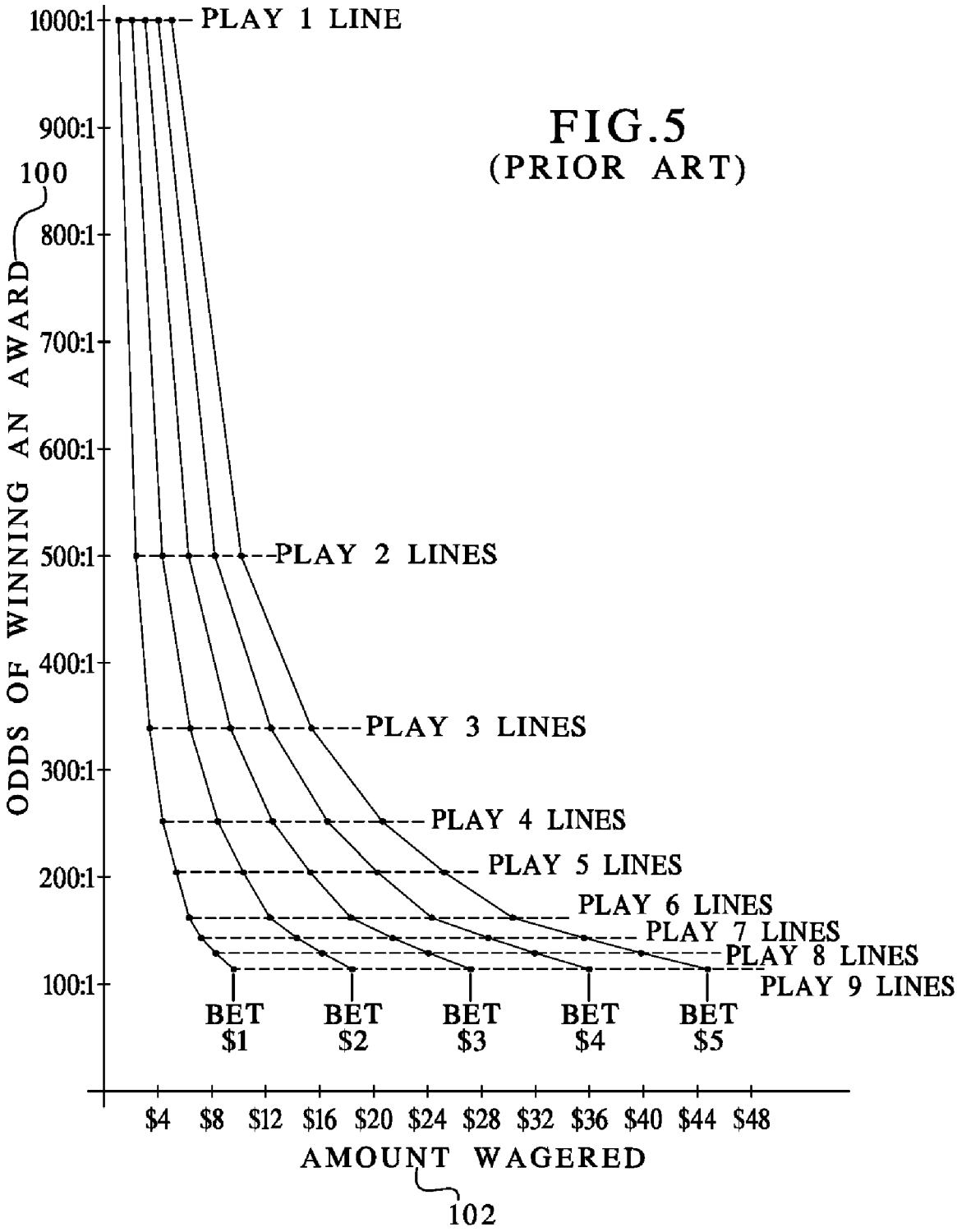
FIG.5 (PRIOR ART)
FIG. 5 is a graph illustrating the odds as a function of a player's bet for the normal operation (i.e., non-jackpot award) of known slot machines.

To aid in the description of the present invention, it is helpful to illustrate the relationship, or lack thereof between the odds, the wager x, the award or jackpot y and the payout ratio z for other known gaming devices. Referring now to FIG. 5, a graph illustrates the odds as a function of a players bet for the normal operation (i.e., non-jackpot award) of known slot machines. The graph includes the odds of winning an award 100 along the y-axis of the graph and the amount wagered or players bet 102 along the x-axis of the graph. Known gaming devices maintain predefined odds for each paying symbol or combination of symbols. The player can obtain more favorable odds by playing more paylines at one time, which increases the players wager.

If for example, on a machine with a minimum wager of $1 per payline, the odds are 1000:1 that a player will obtain three "7" symbols, wherein any "7", "7", "7", in a row pays $100, a player will on average pay $1000 to obtain the "7", "7", "7" once and thereby win $100. The payout ratio z is $100/$1,000 or 0.1. If a standard multi-payline slot machine, as disclosed above, has nine paylines and enables a wager of up to $5 per payline, the player can wager up to $45 on any one spin of the reels or play of the game.

As illustrated in FIG. 5, a player can wager $1 to $5 on one payline, wherein the odds of obtaining a "7", "7", "7" in a row are 1000:1. The player can wager $2, $4, $6, $8 and $10 on two paylines, wherein the odds of obtaining a "7", "7", "7" in a row on either payline are 500:1. The player can wager $3: $6, $9, $12, and $15 on three paylines, wherein the odds of obtaining a "7", "7", "7" in a row on any of three paylines are 333:1. In this manner: the player can wager $4, $8, $12, $16 and $20 on four paylines, wherein the odds are 250:1, $5, $10, $15: $20 and $25 on five paylines, wherein the odds are 200:1; $6, $12, $18, $24 and $30 on six paylines, wherein the odds are 166:1; $7, $14, $21, $28 and $35 on seven paylines, wherein the odds are 142:1; $8, $16: $24, $32 and $40 on eight paylines, wherein the odds are 125:1, and $9, $18, $27: $36 and $45 on nine paylines, wherein the odds are 111:1.

In the normal operation (non-jackpot) of known slot machines, increasing the bet per payline does not increase the players chances of winning. FIG. 5 illustrates that known multi-payline machines maintain a plurality of overlapping odds/wager curves, one per wagerable amount, so that one wager amount can have more than one odds value. For instance, depending upon how the player dispersed a $12 wager, the players odds of winning can be 333:1, 250:1 or 166:1. In the normal operation of known slot machines, therefore, an increase in a wager does not necessarily translate into more favorable odds for the player. In fact, a player betting $9, $1 on nine paylines, has better odds of winning, 111:1, than does a player betting $35, $5 on seven paylines, who has 142:1 odds of winning. However, it should be appreciated that in certain games, there is a larger potential payout, i.e., a jackpot, for winning when the player makes the maximum wager.

Figure 6:
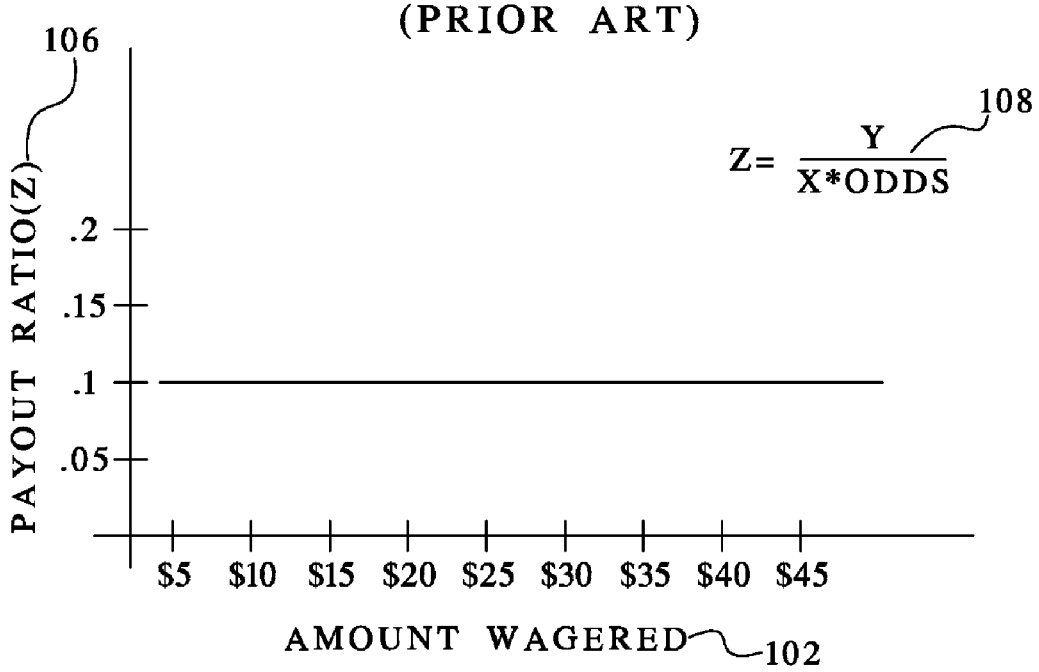
FIG.6 (PRIOR ART)
FIG. 6 is a graph illustrating a plot of the payout ratio as a function of the amount wagered in the normal operation (i.e., non-jackpot award) of known slot machines.

Referring now to FIG. 6, a graph illustrates a plot of the payout ratio as a function of the amount wagered or players bet in the normal operation of slot machines. The graph includes the payout ratio z 106 along the y-axis and amount wagered 102 along the x-axis of the graph. The graph also includes a payout ratio equation 108 including the constituents x, y and odds. The straight horizontal line indicates that the payout ratio z of the normal operation of slot machines is constant regardless of the amount wagered, i.e., regardless of the number of lines played or the amount wagered per line. For example, if the player wagers $1 on one payline in the above example, the payout ratio z is;

$$z=y/(x*\text{odds})=\$100/(\$1*1000)=0.1$$

If the player wagers $5 on nine paylines and therefore wins 5× the payout of any win in the above example, the payout ratio z is:

$$z=y(x*\text{odds})=(5*\$100)/(\$45*111)=0.1$$

Figure 7:
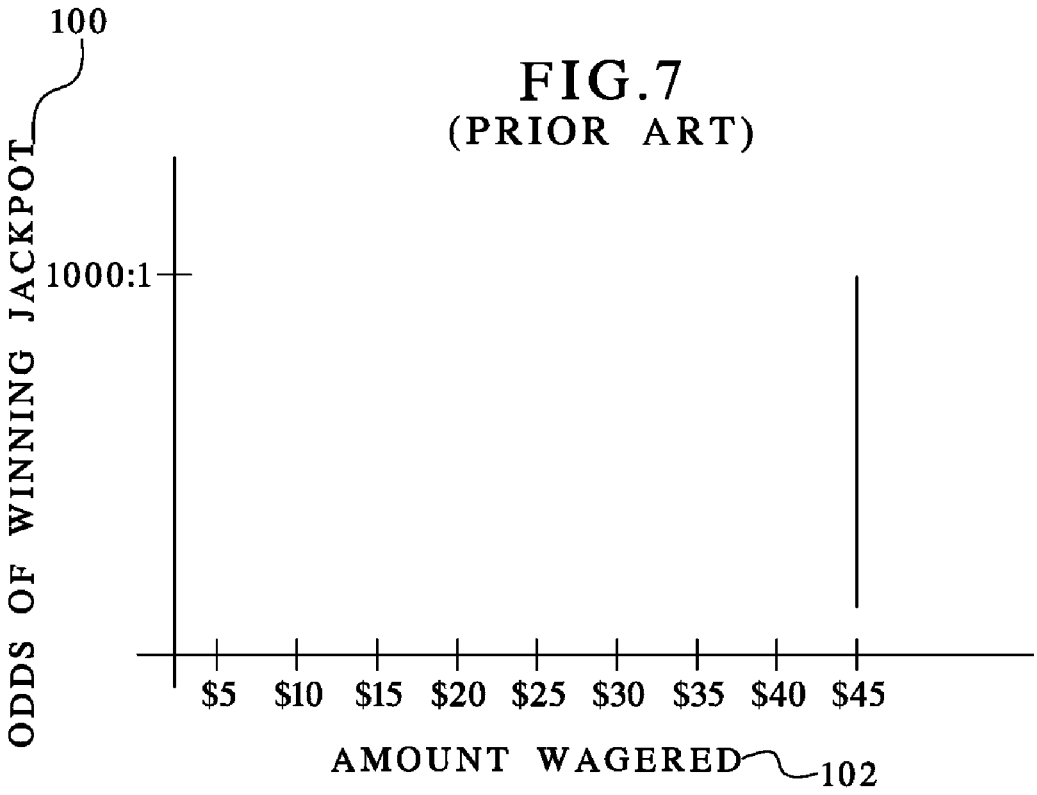
FIG.7 (PRIOR ART)
FIG. 7 is a graph illustrating the odds of winning a jackpot award, including a progressive jackpot, as a function of a players bet for known slot machines having a max bet requirement.
Figure 8:
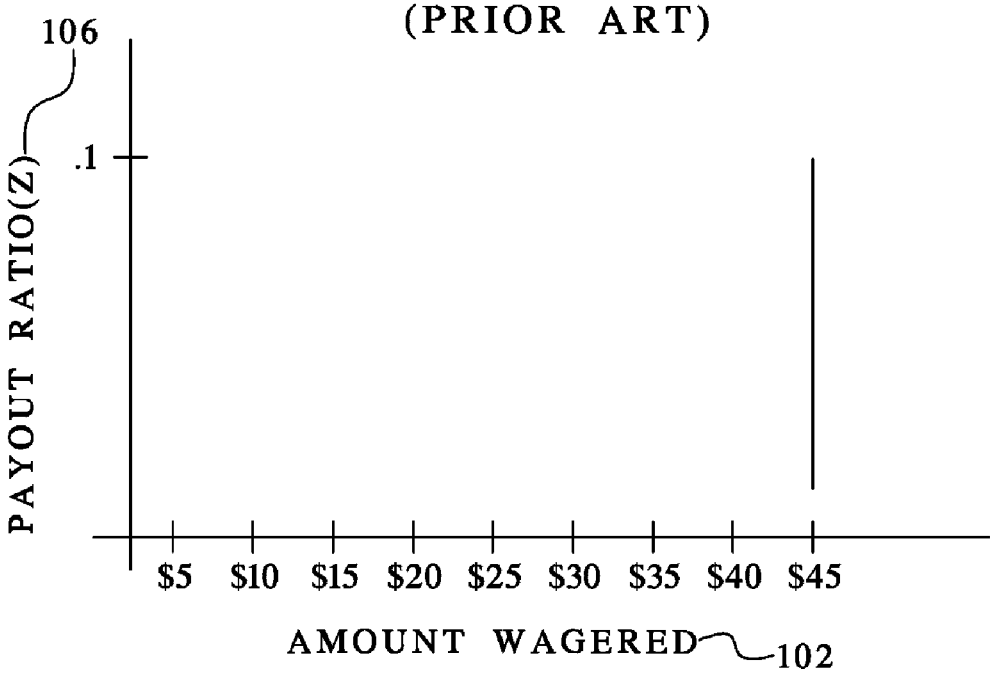
FIG.8 (PRIOR ART)
FIG. 8 is a graph of the prior art illustrating the payout ratio along the y-axis and an amount wagered along the x-axis of the graph, wherein the payout ratio is zero until the player wagers the max bet.

Referring now to FIG. 7, a graph illustrates the odds of winning a jackpot award, including a progressive jackpot, as a function of a player's bet for known slot machines having a max bet requirement. Assume a jackpot of $4,500 at predetermined odds of 1,000:1 exists on a slot machine with a minimum wager of $1 per payline, a maximum wager of $5 per payline and nine paylines. The graph includes the odds of winning the jackpot 100 along the y-axis of the graph and the amount wagered or player's bet 102 along the x-axis of the graph. The graph illustrates that in many known games, there are no odds of winning a jackpot award until the player wagers a max bet, illustrated here as $5 times nine paylines or $45. It should be appreciated that increasing the bet has no affect on the odds of winning the jackpot until the player wagers the max bet. Referring now to FIG. 8, a similar looking graph illustrates the payout ratio 106 along the y-axis and an amount wagered 102 along the x-axis of the graph, wherein the payout ratio is zero until the player wagers the max bet, at which point z=y/(x*odds) $4,5001 ($45*1,000)=0.1.

Figure 9:
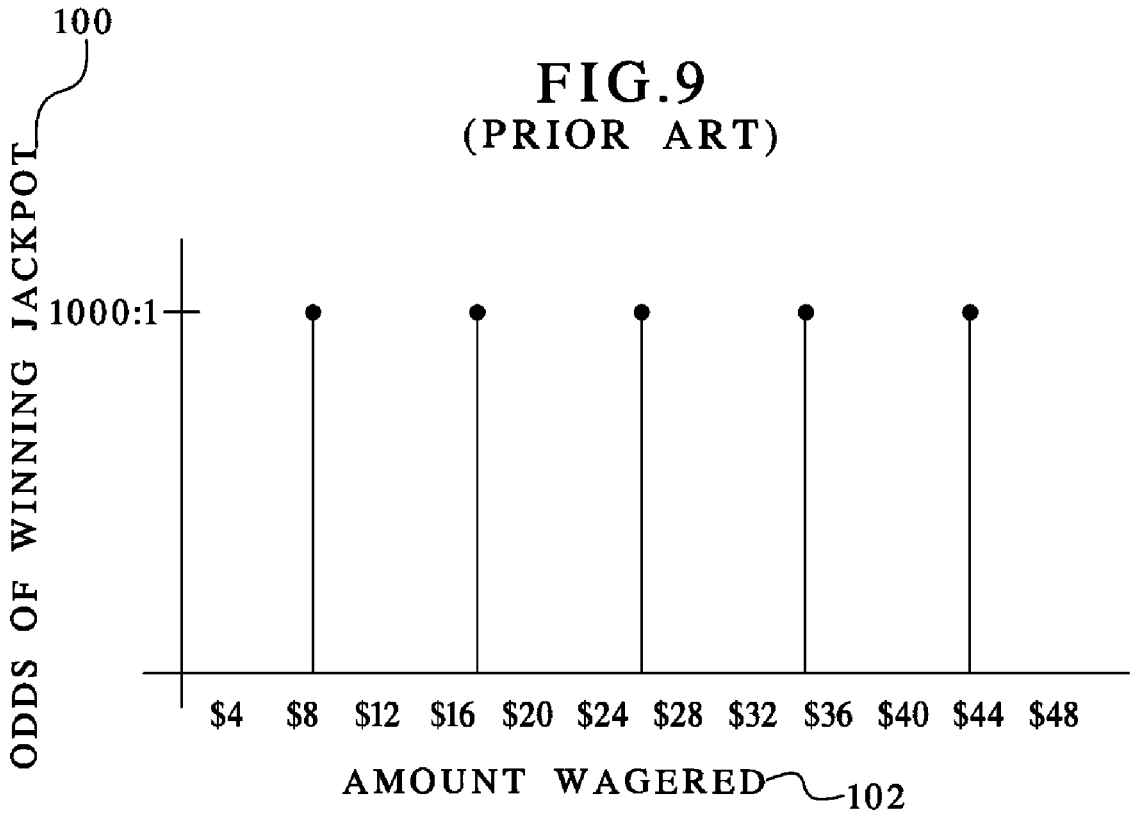
FIG.9 (PRIOR ART)
FIG. 9 is a graph illustrating the odds of winning a jackpot award, including a progressive jackpot, as a function of a players bet for known slot machines having a bet all paylines requirement.
Figure 10:
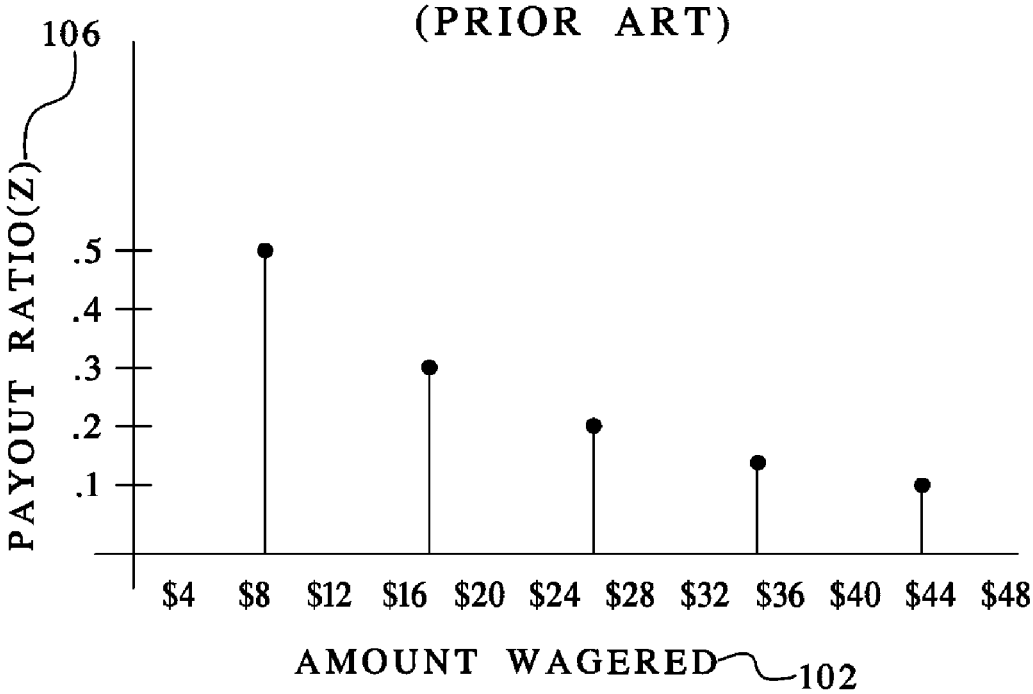
FIG.10 (PRIOR ART)
FIG. 10 is a graph of the prior art illustrating a decreasing payout ratio along the y-axis and an amount wagered along the x-axis, wherein the payout ratio decreases as the wager increases.

Referring now to FIG. 9, a graph illustrates the odds of winning a jackpot award, including a progressive jackpot, as a function of a players bet for known slot machines having a bet all paylines requirement. Assume the same jackpot of $4,500 at predetermined odds of 1,000.1 exists on a slot machine with a minimum wager of $1 per payline, a maximum wager of $5 per payline and nine paylines. The graph includes the odds of winning the jackpot 100 along the y-axis of the graph and the amount wagered or players bet 102 along the x-axis of the graph. The graph illustrates that in known games, there are no odds of winning a jackpot award unit the player plays all nine paylines, illustrated here by the wagers of $9, $18, $27, 36$ and $45. It should be appreciated that increasing the wager has no affect on the odds of winning the jackpot until the player wagers an amount divisible by nine, the number of paylines. Referring now to FIG. 10, a graph illustrates a decreasing payout ratio 106 along the y-axis and an amount wagered 102 along the x-axis of the graph, wherein the payout ratio z, decreases as the wager, x increases and the jackpot, A, and odds remain constant in the equation z=y/(x*odds).

Mechanisms and Methods of Varying Odds Based Upon a Players Bet

The present invention contemplates a gaming device and specifically a slot machine adapted so that any wager enables the player to win any award including a jackpot award and a progressive jackpot award. The present invention further contemplates a gaming device and specifically a slot machine adapted so that an increase in a gaming device wager produces more favorable odds for the player. Given these design parameters, those skilled in the art of gaming device design and manufacturing can develop many different methods and mechanisms embodying the methods to achieve the parameters. As disclosed above, the two components of the vast majority of slot machine wagers include the number of paylines bet and the bet per payline. As disclosed earlier in the specification, many modern slot machines include bonus games in addition to the primary base game, wherein the base game includes the symbol generation via spinning reels. Bonus games can have multiple levels of random generation, so that the odds of achieving an award can be split among two or more levels.

Referring now to FIG. 11, a schematic chart illustrates a plurality of possible games each having a separate method of involving one or more of the wager components with at least one of the base game 112, first bonus level 114 or second bonus level 116. The change of odds or Δ ODDS are expressed either as a function of a change in the number of paylines wagered or ƒ(Δ #paylines), as a function of a change in the bet per payline or ƒ(Δ $/payline) or for a single payline machine as a function of a change in the bet or ƒ(Δ bet). These methods are described in detail below by one possible implementation of the method. It should be appreciated that those skilled in the art can develop many different implementations for each of the methods. The present invention is not therefore limited to the implementations disclosed.

Game 1

Figure 12:
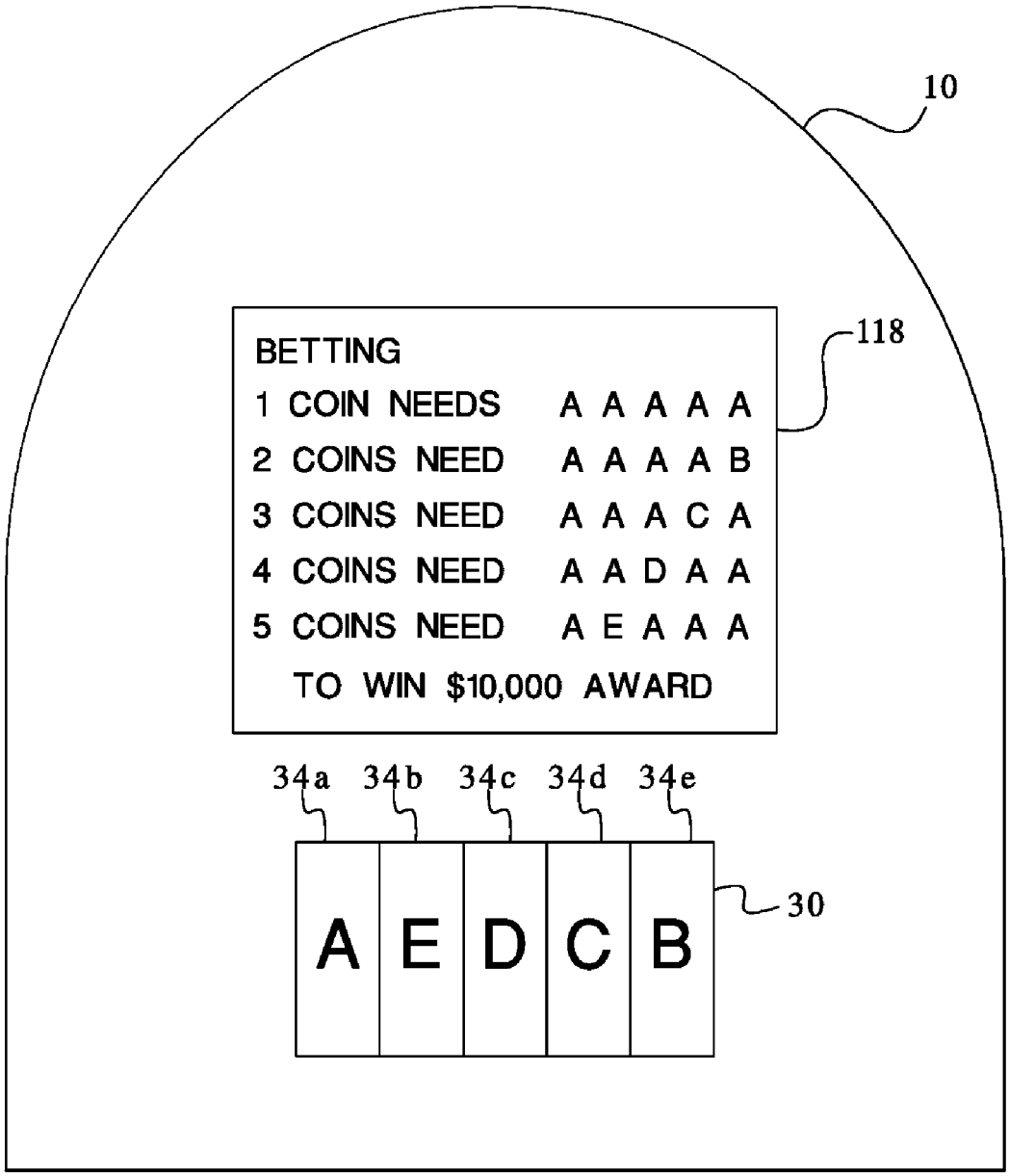
FIG. 12 is a front plan view of a portion of the gaming device which includes the apparatus necessary to carry out the method of Game 1 of FIG. 11, wherein the present invention varies the odds as a function of the bet per payline in the base game.

Referring now to FIG. 12, a front plan view of a portion of gaming device 10 including the apparatus necessary to carry out the method of Game 1 of FIG. 11 is illustrated. In the method disclosed in FIG. 11 for Game 1, the change in odds depends only a change in the wager amount. In FIG. 12, gaming device 10 includes a single payline machine having no bonus round, a $1 minimum bet and an award of $10,000 having a payout ratio z of 0.1. FIG. 12 includes a paytable 118 illustrating that to win the $10,000 award, betting: 1 coin ($1) requires a "A", "A", "A", "A", "A" combination, 2 coins ($2) requires a "A", "A", "A", "A", "B" combination; 3 coins ($3) requires a "A", "A", "A", "C", "A" combination, 4 coins ($4) requires a "A", "A", "D", "A", "A" combination and 5 coins ($5) requires a "A", "E", "A", "A", "A" combination.

The central display device 30 includes five well known reels, wherein each reel 34*a* through 34*e* includes a 1/10 chance of the game generating an "A". Reel 34*b* includes a 1/2 chance of the game generating an "F". Reel 34*c* includes a 2/5 chance of the game generating a "D". Reel 34*d* includes a 3/10 chance of the game generating a "C", Reel 34*e* includes a 1/5 chance of the game generating a "B".

It should be appreciated by one skilled in the art that in the method and apparatus of FIG. 12, $100,000 will have to be wagered, on average, to win the $10,000 award regardless of the amount that the player bets. It should also be appreciated that the players odds of winning, according the equation, odds=y/(x*z), become more favorable to the player as the player increases the players wager. It should further be appreciated that one skilled in the art can implement a similar game to Game 1, wherein the game provides and the paytable displays different winning combinations having varying odds or chance at being randomly generated, and wherein the combinations and thus the odds change as a function of a change in the number of paylines wagered.

Game 2

Figure 13:
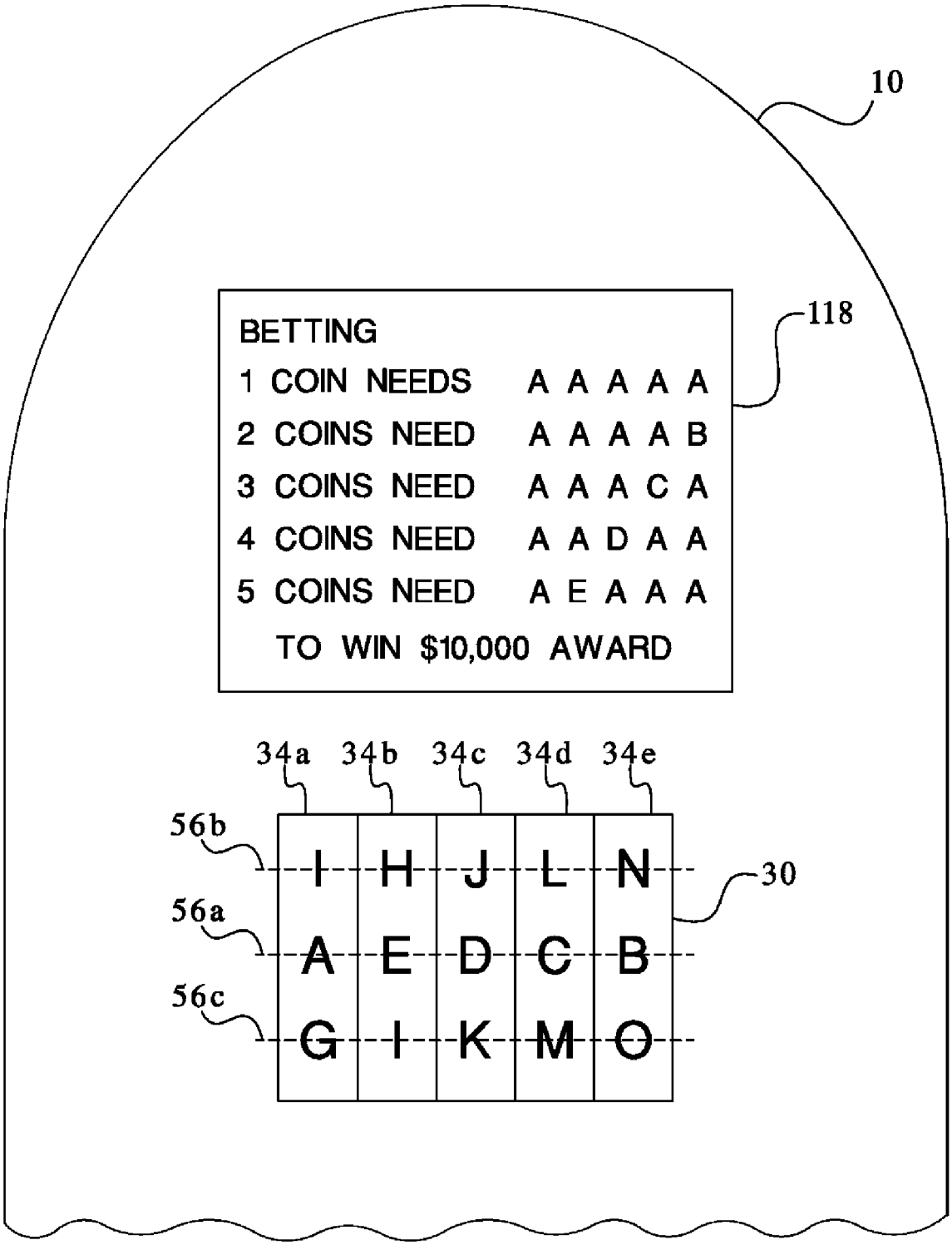
FIG. 13 is a front plan view of a portion of the gaming device which includes the apparatus necessary to carry out the method of Game 2 of FIG. 11, wherein the present invention varies the odds as a function of changing the number of paylines wagered and the odds as a function of changing the bet per payline in the base game.

Referring now to FIG. 13: a front plan view of a portion of gaming device 10 including the apparatus necessary to carry out the method of Game 2 of FIG. 11 is illustrated. In the method disclosed in FIG. 11 for Game 2, the change in odds depends on a change in the number of lines wagered and on the bet per line amount. In FIG. 13, gaming device 10 includes a three payline machine having no bonus round a $1 minimum bet and an award of $10,000 having a payout ratio z of 0.1. FIG. 13 includes the same paytable 118 illustrated with FIG. 12.

The central display device 30 includes the same five reels 34*a* through 34*e*, having the same symbol positions, as the reels of FIG. 12. Thus for one payline, the Game 2 is exactly the same as the embodiment of Game 1. In this embodiment, the central display device 30 displays three paylines 56*a* through 56*c*. The player can thus make the odds twice as favorable by playing two paylines and three times as favorable by playing three paylines. Accordingly, the player's wager increases two times by playing two paylines and three times by playing three paylines.

It should be appreciated by one skilled in the art, that in Game 2, $100,000 will need to be wagered, on average to win the $10,000 award regardless of the number of paylines wagered or the bet per payline. It should also be appreciated that the player's odds of winning, according the equation, odds=y/(x*z) become more favorable to the player as the player increases the number of paylines wagered and/or the bet per payline.

Game 3

Figure 14:
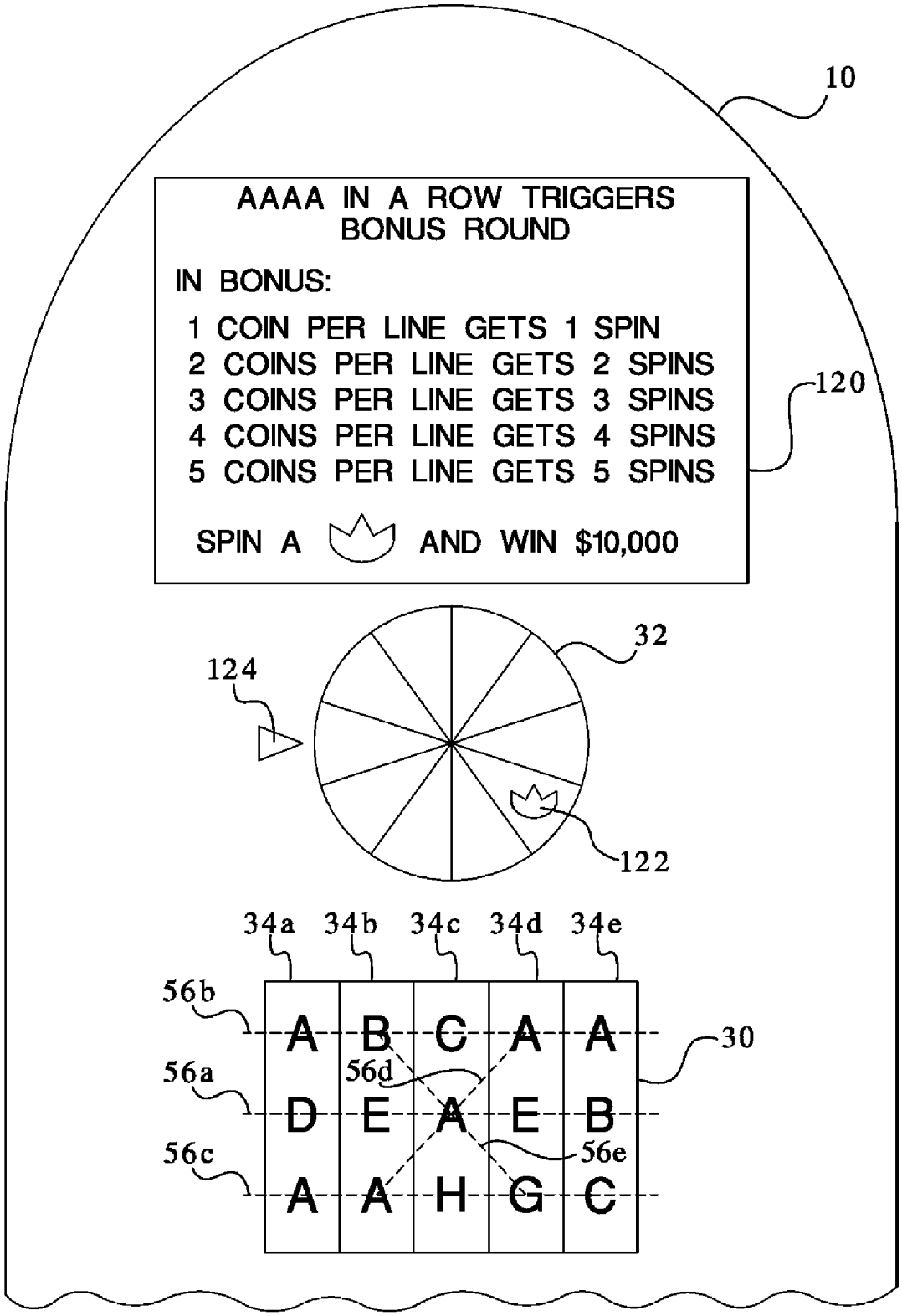
FIG. 14 is a front plan view of a portion of the gaming device which includes the apparatus necessary to carry out the method of Game 3 of FIG. 11, wherein the present invention varies the odds as a function of changing the number of paylines wagered in the base game and the odds as a function of changing the bet per payline in the bonus round.

Referring now to FIG. 14, a front plan view of a portion of gaming device 10 including the apparatus necessary to carry out the method of Game 3 of FIG. 11 is illustrated. In the method disclosed in FIG. 11 for Game 3, the change in odds depends on a change in the number of lines wagered and on the bet per line amount. The base game odds 112 factor in the number of lines wagered and the bonus game odds 114 factor in the bet per payline. In FIG. 14, gaming device 10 includes a five payline machine having a bonus round, a $1 minimum bet and an award of $10,000 having a payout ratio z of 0.1.

FIG. 14 includes a paytable 120 illustrating that an "A", "A", "A", "A" combination on any payline triggers the bonus round and that betting: 1 coin($1)/line gives the player one spin in the bonus round; 2 coins($2)/line gives the player two spins in the bonus round; 3 coins($3)/line gives the player three spins in the bonus round; 4 coins($4)/line gives the player four spins in the bonus round, and 5 coins($5)/line gives the player five spins in the bonus round. Spinning a shield symbol yields the $10,000 award.

FIG. 14 includes an upper display device 32, which is a rotatable wheel having ten equally sized pie-shaped sections. One of the sections contains a shield symbol 122. A cursor 124 designates one of the rotatable sections at all times. A player thus has a 1/10 chance of the spinning wheel stopping so that the cursor 124 designates the section containing the shield symbol 122.

In the bonus round of Game 3, the player who bets $1 per payline spins once and has a 1/10 chance of winning. The player who bets $2 per payline spins twice and has a 1/5 chance of winning. The player who bets $3 per payline spins three times and has a 3/10 chance of winning. The player who bets $4 per payline spins four times and has a 2/5 chance of winning. The player who bets $5 per payline spins five times and has a 1/2 chance of winning.

The base game embodied by the central display device 30 includes five well known reels, wherein each reel 34*a* through 34*e* includes a 1/10 chance of the game generating an "A". Game 3 requires an "A", "A", "A", "A" combination to trigger the bonus round. The central display device 30 displays five paylines 56*a* through 56*e*. The player can thus make the odds twice as favorable by playing two paylines, three times as favorable by playing three paylines, etc. Accordingly, the player's wager increases two times by playing two paylines, three times by playing three paylines, etc.

It should be appreciated that in Game 3, $100,000 will need to be wagered, on average, to win the $10,000 award regardless of the number of paylines wagered or the bet per payline. It should also be appreciated that the odds of winning, according the equation, odds=y/(x*z) become more favorable as the players wager increases. It should further be appreciated that the odds of entering the bonus round become more favorable to the player as the player increases the number of paylines wagered and the odds of winning the bonus round become more favorable to the player as the player increases the bet per payline.

Game 4

Figure 15:
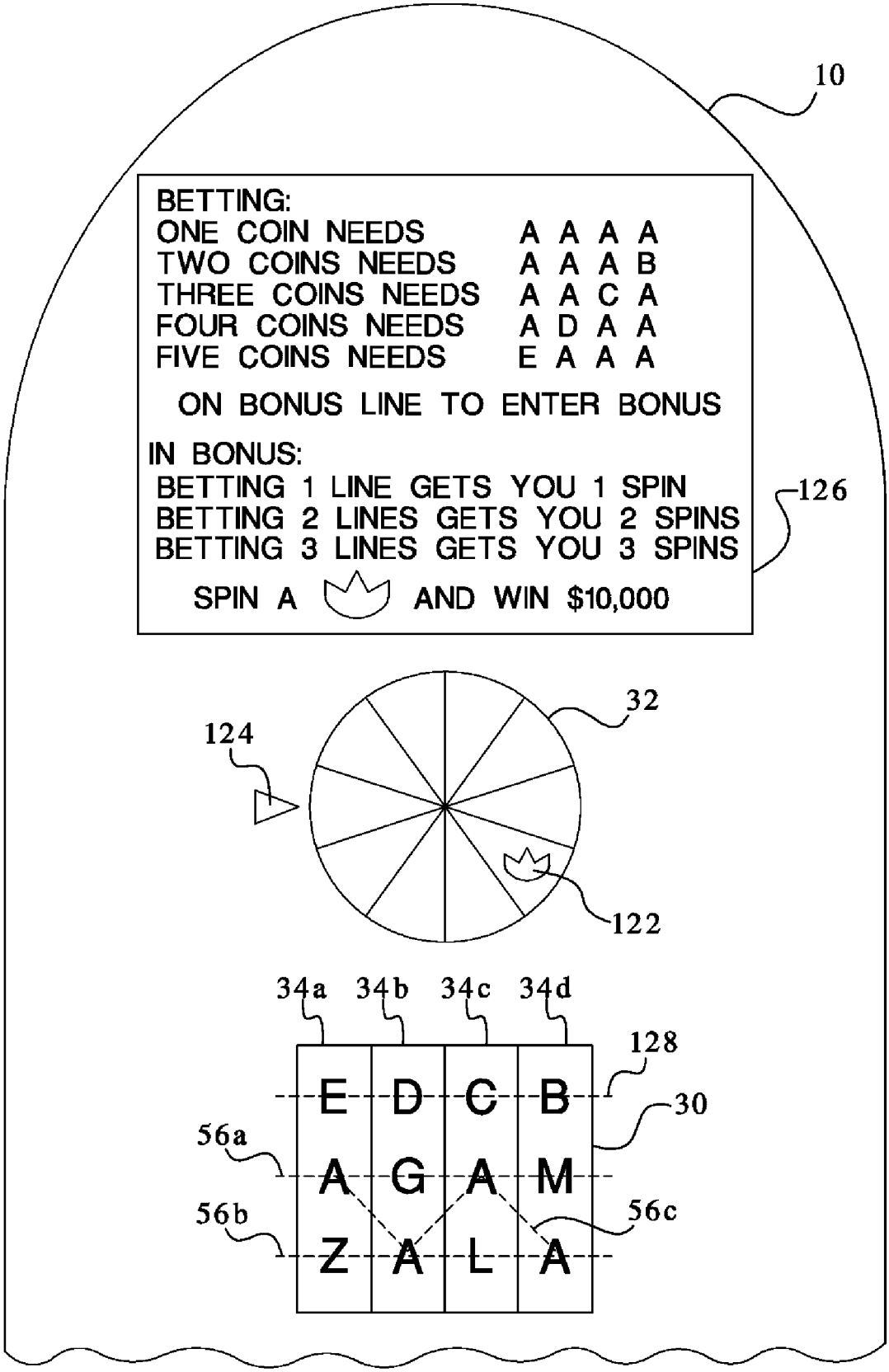
FIG. 15 is a front plan view of a portion of the gaming device which includes the apparatus necessary to carry out the method of Game 4 of FIG. 11, wherein the present invention varies the odds as a function of changing the bet per payline in the base game and the odds as a function of changing the number of paylines wagered in the bonus round.

Referring now to FIG. 15, a front plan view of a portion of gaming device 10 including the apparatus necessary to carry out the method of Game 4 of FIG. 11 is illustrated. In the method disclosed in FIG. 11 for Game 4, the change in odds depends on a change in the number of paylines wagered and on the bet per line amount. The base game odds 112 factor in the bet per payline and the bonus game odds 114 factor in the number of lines wagered. In FIG. 15, Game 4 includes a three payline machine having a bonus round, a $1 minimum bet and an award of $10,000 having a payout ratio z of 0.1.

FIG. 15 includes a paytable 126 illustrating that to enter the bonus round from the base game, betting: 1 coin ($1) requires a "A"; "A", "A", "A" combination along the bonus line, 2 coins ($2) requires a "A", "A", "A", "B" combination along the bonus line, 3 coins ($3) requires a "A", "A", "A" combination along the bonus line, 4 coins ($4) requires a "A", "D", "A", "A" combination along the bonus line; and 5 coins ($5) requires a "E", "A", "A", "A" combination along the bonus line 128. In the bonus, betting: one line gives the player one spin; two lines gives the player two spins; and three lines gives the player three spins. Spinning a shield symbol yields the $10,000 award.

The central display device 30, embodying the base game, includes four well known reels, wherein each reel 34*a* through 34*d* includes a 1/10 chance of the game generating an "A". Reel 34*a* includes a 1/2 chance of the game generating an "F". Reel 34*b* includes a 2/5 chance of the game generating a "D". Reel 34*c* includes a 3/10 chance of the game generating a "C". Reel 34*d* includes a 1/5 chance of the game generating a "B". In this embodiment, the central display device 30 displays three paylines 56*a* through 56*c*. None of the paylines includes any of the symbols displayed in the top row of the central display device 30, which is the bonus line 128. Game 4 analyzes only the bonus line 128 to determine if the player enters the bonus round. That is, Game 4 does not analyze the paylines 56*a* through 56*c* to determine if the player enters the bonus round.

FIG. 15 includes an upper display device 32, which is a rotatable wheel having ten equally sized pie-shaped sections. One of the sections contains a shield symbol 122. A cursor 124 designates one of the rotatable sections at all times. A player thus has a 1/10 chance of the spinning wheel stopping so that the cursor 124 designates the section containing the shield symbol 122.

In the bonus round of Game 4, the player who plays one payline spins once and has a 1/10 chance of winning. The player who plays two paylines spins twice and has a 1/5 chance of winning. The player who plays three paylines spins three times and has a 3/10 chance of winning. The player can thus make the odds twice as favorable by playing two paylines and three times as favorable by playing three paylines. Accordingly, the players wager increases two times by playing two paylines and three times by playing three paylines.

It should be appreciated that in Game 4, $100,000 will need to be wagered, on average, to win the $10,000 award regardless of the number of paylines wagered or the bet per payline. It should also be appreciated that the player's odds of winning, according the equation, odds=y/(x*z) become more favorable to the player as the player increases the players wager. It should further be appreciated that the odds of entering the bonus round become more favorable to the player as the player increases the bet per payline and the odds of winning the bonus round become more favorable to the player as the player increases the number of paylines wagered.

Game 5

Figure 16:
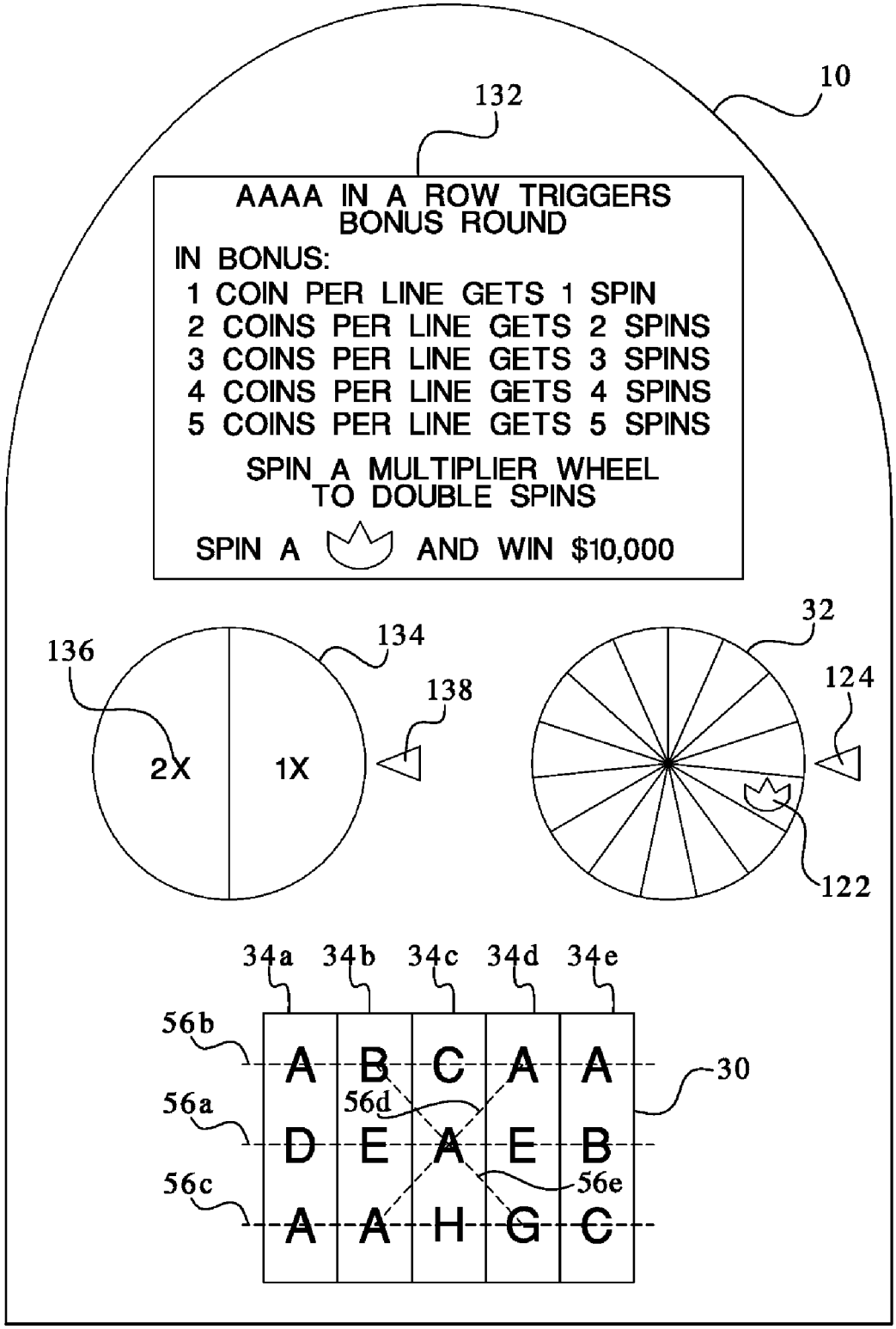
FIG. 16 is a front plan view of a portion of the gaming device which includes the apparatus necessary to carry out the method of Game 5 of FIG. 11, wherein the present invention varies the odds in the base game and the bonus round and provides an additional odds constant in the bonus round.

Referring now to FIG. 16, a front plan view of a portion of gaming device 10 including the apparatus necessary carry out the method of Game 5 of FIG. 11 is illustrated. As mentioned earlier, the bonus round provides the implementer of the gaming device with an opportunity to split the odds necessary to complete the game math into two or more parts. In the method disclosed in FIG. 11 for Game 5, the change in odds depends on a change in the number of lines wagered and on the bet per line amount as disclosed above in connection with FIG. 14 or Game 3. The base game odds 112 factor in the number of paylines wagered and the second bonus level odds 116 factor in the bet per payline. The implementer also provides first bonus level odds 114 in the form of an odds constant 130.

In FIG. 16, gaming device 10 includes a five payline machine having a bonus round, a $1 minimum bet and an award of $10,000 having a payout ratio z of 0.1. FIG. 16 also includes a paytable 132 illustrating that an "A", "A", "A", "A" combination on any payline triggers the bonus round and that betting: 1 coin($1)/line gives the player one spin in the bonus round; 2 coins($2)/line gives the player two spins in the bonus round; 3 coins($3)/line gives the player three spins in the bonus round; 4 coins($4)/line gives the player four spins in the bonus round, and 5 coins($5)/line gives the player five spins in the bonus round. The player can also spin a multiplier wheel to double the players bonus round spins. Spinning a shield symbol yields the $10,000 award.

FIG. 16 includes an upper display device 32, which is a rotatable wheel having fifteen equally sized pie-shaped sections. One of the sections contains a shield symbol 122 that yields the $10,000 award. A cursor 124 designates one of the rotatable sections at all times. A player thus has a 1/15 chance of the spinning wheel stopping so that the cursor 124 designates the section containing the shield symbol 122. FIG. 16 also includes a second upper display device 134, which is a rotatable wheel having two equally sized pie-shaped sections. One of the sections contains a "2×" symbol 136. A second cursor 138 designates one of the rotatable sections at all times. A player thus has a 1/2 chance, the odds constant 130, of the spinning wheel stopping so that the second cursor 138 designates the section containing the "2×" symbol 136.

In the first level of the bonus round of Game 5, the player spins the rotatable wheel of the second upper display device 134 once regardless of the amount that the player has wagered per payline or the number of paylines wagered. The 1/2 chance of obtaining the "2×" symbol 136, which doubles the player's number of spins, is thus constant, i.e., exists for every player entering the bonus round.

In the second level of the bonus round of Game 5, the player who bets $1 per payline spins once 50% of the time and twice 50% of the time. It should be appreciated that the player thus has an overall 1/10 chance of winning. The player who bets $2 per payline spins twice 50% of the time and four times 50% of the time. It should be appreciated that the player thus has an overall 1/5 chance of winning. The player who bets $3 per payline spins three times 50% of the time and six times 50% of the time. It should be appreciated that the player thus has an overall 3/10 chance of winning. The player who bets $4 per payline spins four times 50% of the time and eight times 50% of the time. It should be appreciated that the player thus has an overall 2/5 chance of winning. The player who bets $5 per payline spins five times 50% of the time and ten times 50% of the time. It should be appreciated that the player thus has an overall 1/2 chance of winning.

The base game embodied by the central display device 30 includes five well known reels, wherein each reel 34*a* through 34*e* includes a 1/10 chance of the game generating an "A". Game 5 requires an "A", "A", "A", "A" combination to trigger the bonus round. The central display device 30 displays five paylines 56*a* through 56*e*. The player can thus make the odds twice as favorable by playing two paylines, three times as favorable by playing three paylines, etc. Accordingly, the player's wager increases two times by playing two paylines, three times by playing three paylines, etc.

It should be appreciated that in Game 5, $100,000 will have to be wagered, on average, to win the $10,000 award regardless of the number of paylines wagered or the bet per payline. It should also be appreciated that the players odds of winning, according the equation, odds=y/(x*z) become more favorable to the player as the player increases the player's wager. It should further be appreciated that the odds of entering the bonus round become more favorable to the player as the player increases the number of paylines wagered and the odds of winning the bonus round become more favorable to the player as the player increases the bet per payline.

The odds constant 130, which the implementer can infuse into the present invention, does not alter the fact that the player increases the chances of winning by wagering more money. Game 5 achieves the design parameters, (i) providing a gaming device adapted so that any wager enables the player to win any award including a jackpot award and a progressive jackpot award- and (ii) providing a gaming device adapted so that an increase in a gaming device wager produces more favorable odds for the player, despite the odds constant 130.

Referring to FIG. 11, Game 5 infuses the odds constant 130 into Game 3, whereby the change in odds as a function of the change in the bet per payline is shifted from the first bonus level odds 114 in Game 3 to the second bonus level odds 116 in Game 5. It should be appreciated that one skilled in the art of gaming device design can design a game, wherein the change in odds as a function of the change in the bet per payline remains in the first bonus level odds 114, e.g., occurs first, and wherein the second bonus level odds 116 include the odds constant 130. It should also be appreciated that one skilled in the art can so infuse the odds constant 130 into other configurations and implementations of the present invention, such as Game 1, Game 2 and Game 4 discussed above. It should further be appreciated that one skilled in the art can implement a similar game to Game 5, wherein the wager per payline determines the base game odds and the number of wagered paylines affects the bonus level odds, e.g., the first bonus level odds 114, the second level odds 116 or both.

Figure 17:
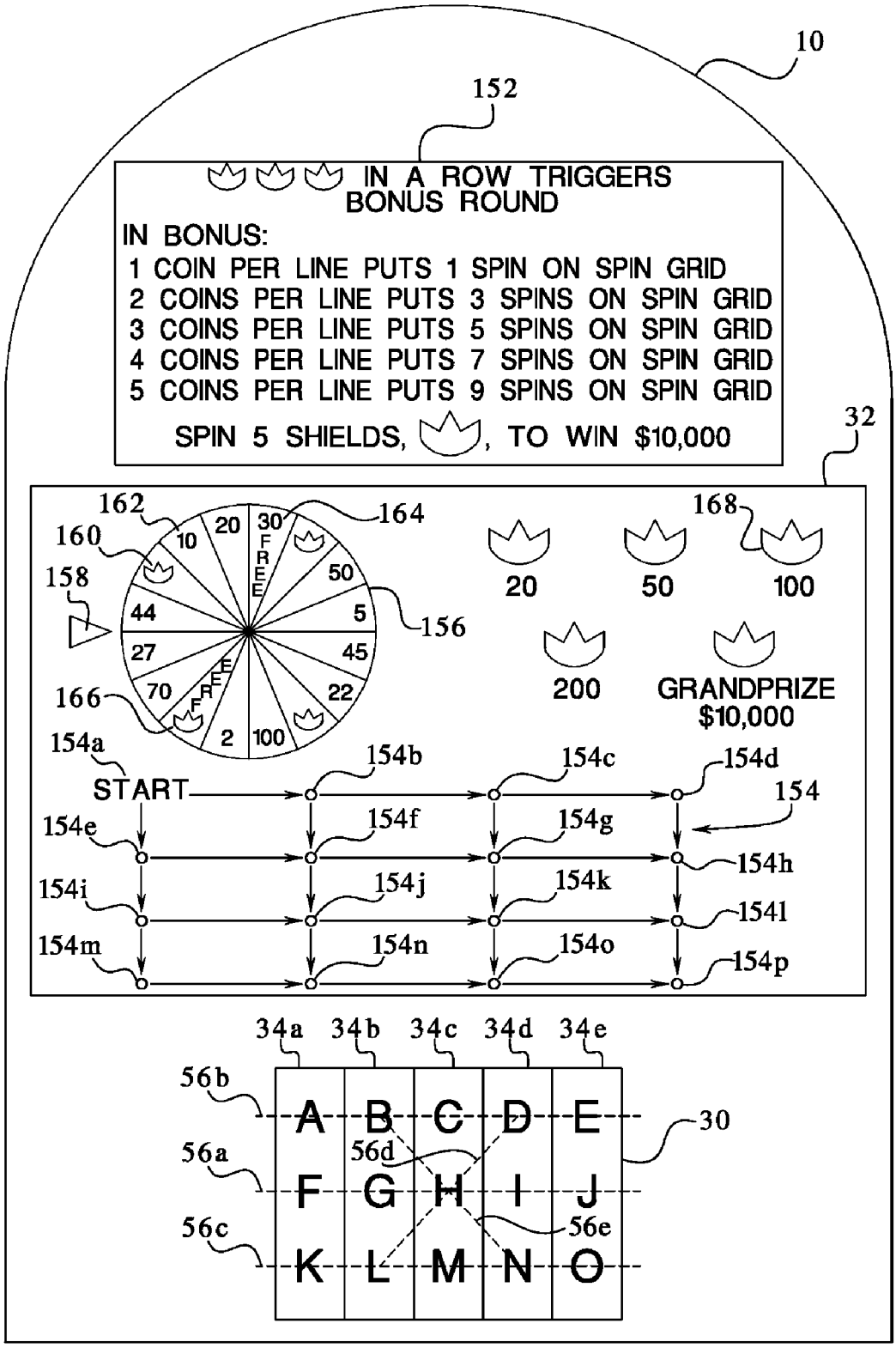
FIG. 17 is a front plan view of a portion of the gaming device which includes a preferred embodiment of the present invention.

Referring now to FIG. 17, a front plan view of gaming device 10 including a preferred embodiment of the present invention is illustrated. FIG. 17 illustrates an example wherein the change in odds as a function of the change in the bet per payline occurs in the first and second bonus level odds 114 and 116, and wherein the first and second bonus level odds include odds constants 130. The example illustrates that the first and second bonus level odds 114 and 116 contain a plurality of odds constants 130 and that the bonus round contains a plurality of awards in addition to the $10,000 grand prize or jackpot.

Paytable 152 discloses that three bonus symbols or shields in a row triggers a bonus round. As disclosed in connection with Game 3 and Game 5 of FIG. 11, the player increases the odds of entering the bonus round by playing or betting more paylines, Paytable 152 discloses that betting more coins per payline puts more "spins" or desirable outcomes on a "spin grid." As will be illustrated, the "spin grid" is a separate bonus game containing a separate odds constant 130 in addition to a component to the odds that changes as a result of the player's wager. Paytable 152 also discloses that the grand prize or jackpot award of $10,000 is available for a player who achieves five shields in a second bonus game, wherein the second bonus game also includes an odds constant.

The bonus games of the preferred embodiment are illustrated as simulations on the upper display device 32. It should be appreciated that either or both could be separate electromechanical displays. The spin grid game 154 contains fifteen selectable positions 154*b* through 154*p*. Each of these positions preferably associates with an award value or with a spin. The player begins at a start position 154*a* and can move right or down, i.e., to position 154*b* or 154*e*. The player will stop at five positions, moving right or down, until stopping at a sixth and final position 154*p*. It should be appreciated that a player, regardless of an amount bet, wilt always touch or land on six of the fifteen positions 154*b* through 154*p*. Thus an odds constant 130, inherent to the spin gad game 154 of 6/15 or 2/5 exists, regardless of an amount bet, by virtue of game design.

In the spin grid game 154, a spin at the grand prize is the most desirable position outcome. The more spins the player can land on and accumulate, the better chance the player has later on. As described above with paytable 152, the game assigns a number of spins to the positions, 154*b* through 154*p* based upon the players bet per payline. The game preferably randomly assigns the spins to a position but could also predetermine the placement. If the player bets one coin, the game only places one spin on the grid, which the player then can select.

The odds become more complicated when the player bets four or five coins per payline, wherein the grid then contains more spins than the player can possibly select. For example, if the player bets five coins, the game places nine spins on the grid 154, of which the player can randomly pick or land on up to six. The overall odds are also effected if the implementer preferably predetermines that one spin is always assigned to the final position 154*p* because the player is guaranteed to land on the final position 154*p*. The game design also makes the odds of selecting 154*b*, 154*e*, 154*l* and 154*o* greater than the odds of selecting 154*c*, 154*f*, 154*i* and 154*h*, 154*k* and 154*n*, which are greater than the odds of selecting 154*d*, 154*g*, 154*j* and 154*m*. The overall odds of the spin grid game 154 are thus effected by a plurality of different odds constants 130 via the game design. Importantly, the number of spins placed on the grid, which the player controls via the players wager, is always a factor of the player's overall odds of obtaining spins in the spin grid 154. Thus, betting more coins per payline will always increase the player's odds assuming that all other circumstances are the same, i.e., the positioning of spins.

When the player finishes playing the spin grid game 154, and assuming the player has at least one spin, the player moves onto the second bonus game, which includes a spinning wheel 156 having a plurality of wedge-shaped sections and a fixed cursor 158. The cursor 158 designates one of the wedge-shaped sections at all times. The wedges include a plurality of shields 160, a plurality of awards 162, preferably at least one free spin plus award 164 and preferably at least one free spin plus a shield 166. The number of shields 160, number of free spin plus shield wedges 166 and the overall number of wedges affect the overall odds of obtaining shields. If the player obtains five shields, the player wins the grand prize or jackpot, as illustrated by table 168. The game also preferably provides consolation awards for obtaining one through four shields.

It should be appreciated that the number of spins also affects the overall odds of obtaining shields in the second bonus game or, in the second bonus level odds 116. In effect, the spinning wheel 156 of the second bonus level contains overall odds of winning the grand prize, which are a function of a plurality of odds constants 130 and the number of spins that the player obtains from the spin grid game 154. Likewise, the spin grid game 154 contains overall odds of the player obtaining a certain number of spins, which are a function of a plurality of odds constants 130 and the wagered coins per payline. The overall odds of winning the grand prize are thus a function of the wagered coins per payline. As stated above, the odds of entering the bonus round are a function of the number of wagered lines. It should be appreciated that any wager enables the player to win the grand prize or jackpot of the preferred embodiment, that increasing the players wager increases the players chances of winning the award, and that varying the number of bonus levels and/or the number of odds constants within the levels does not alter the satisfaction of these design parameters.

Game 6

Referring now to FIG. 18, a front plan view of a portion of gaming device 10 including the apparatus necessary to carry out the method of Game 6 of FIG. 11 is illustrated. In the method disclosed in FIG. 11 for Game 6, the base game odds 112 include the odds constant 130. Game 6 provides an example wherein the design parameters are achieved solely in the bonus round. That is, the first bonus level odds 114 include the change in odds as a function of a change in the number of paylines wagered, and the second bonus level odds 116 include the change in odds as a function of the bet per payline.

In FIG. 18, Game 6 includes a three payline machine having a bonus round, a $1 minimum bet and an award of $10,000 having a payout ratio z of 0.1. FIG. 18 also includes a paytable 140 illustrating that a "B" symbol on any payline triggers the bonus round and that two solid pie shapes wins the $10,000 award. Paytable 140 also illustrates that betting: 1 payline gives the player one spin; 2 paylines gives the player two spins' and 3 paylines gives the player three spins on the payline wheel in the bonus round. Paytable 140 also illustrates that betting: 1 coin($1)/line gives the player one spin; 2 coins($2)/line gives the player two spins; and 3 coins($3)/line gives the player three spins on the bet per line wheel in the bonus round.

The base game of Game 6 embodied by the central display device 30 includes three well known reels 34*a* through 34*c*. Only the center reel 34*b* includes the bonus triggering "B" symbol, wherein a player has a 1/40 chance, the odds constant 1304 of triggering the bonus round. The central display device 30 displays three paylines 56*a* through 56*c*. In the center reel 34*b*, each payline passes through the center paystop position 142. A bonus triggering "B" symbol landing on the center paystop position 142 thus lands on all three paylines 56*a* through 56*c* at once. It should be appreciated that wagering on more paylines does not provide the player with more favorable odds of entering the bonus round of Game 6. The odds of triggering the bonus round are set or constant at 40:1 for each player regardless of the number of paylines wagered or the bet per payline.

The bonus round of Game 6 includes a rotatable payline wheel 1444 which is a wheel having fifty equally sized pie-shaped sections. One of the sections 148 is darkened or bolded. A cursor 150 designates one of the rotatable sections at all times. A player thus has 50:1 odds, the first bonus level odds 114, of the spinning wheel stopping so that the cursor 150 designates the darkened pie section 148. The player can make the odds twice as favorable by playing two paylines and obtaining two spins or three times as favorable by playing three paylines and obtaining three spins. Accordingly, the player's wager increases two times by playing two paylines and three times by playing three paylines.

The bonus round of Game 6 also includes a rotatable bet per line wheel 146, which is also a wheel having fifty equally sized pie-shaped sections. One of the sections 148 is likewise darkened or bolded. A second cursor 150 designates one of the rotatable sections at all times. A player thus has 50.1 odds, the second bonus level odds 1164 of the spinning wheel stopping so that the cursor 150 designates the darkened pie section 148. The player can make the odds twice as favorable by betting two coins per payline and obtaining two spins or three times as favorable by betting three coins per payline and obtaining three spins. Accordingly, the player's wager increases two times by betting two coins per payline and three times by betting three coins per payline.

The player wins the $10,000 when both cursors 150 designate both darkened pie sections 148. It should be appreciated that in Game 6, $100,000 will need to be wagered, on average, to win the $10,000 award regardless of the number of paylines wagered or the bet per payline. It should also be appreciated that the players odds of winning, according the equation, odds=y/(x*z) become more favorable to the player as the player increases the player's wager. It should further be appreciated that the odds of entering the bonus round are fixed or constant. The odds of winning the bonus round become more favorable to the player as the player increases the number of paylines wagered. The odds of winning the bonus round also become more favorable to the player as the player increases the bet per payline. It should still further be appreciated that although the base game odds, the odds constant 130, do not vary, the odds still factor into the overall odds of winning the award. It should yet be appreciated that one skilled in the art can implement a similar game to Game 6, wherein the wager per payline determines the first bonus level odds 114 and the number of wagered paylines determines the second bonus level odds 116.

Referring again to FIG. 11, for the purposes of illustration, FIGS. 16 and 18 describing Game 5 and Game 6, respectively, disclose one odds constant 130. As illustrated in the preferred embodiment of FIG. 17, one skilled in the art can design a game having a plurality of odds constants, such as odds constant 130, wherein one or more odds constants are associated with a random generation mechanism or device. The implementer can further infuse one or more odds constants into the base game and the bonus game. The base game can employ methods, such as adding separate unfunctional paylines to the reels as is done in FIG. 15 via the bonus line 128, so that the reels can perform more than one function. The bonus game can include any number of odds producing levels such as a third, fourth or fifth bonus level odds.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims, Modifications and variations in the present invention may be made without departing from the novel aspects of the invention as defined in the claims, and this application is limited only by the scope of the claims.

The invention is claimed as follows:

1. A gaming system comprising:

at least one input device;

at least one display device;

at least one processor; and at least one memory device storing a plurality of instructions, which when executed by the at least one processor, cause the at least one processor to operate with the at least one input device and the at least one display device, for a play of a game, to:

(i) accept an input of a wager on a number of a plurality of paylines;

(ii) after input of the wager, display one of a plurality of different combinations of symbols at a plurality of symbol positions associated with a plurality of reels, wherein the plurality of paylines are each associated with a plurality of the reels;

(iii) determine if a designated one of the combinations of symbols has been displayed along one of the paylines, wherein for each payline, odds of generating said designated combination of symbols on that payline vary based on the wager per payline; and (iv) if said designated combination of symbols has been displayed along a wagered on one of the paylines, initiate a bonus game having a plurality of levels and associated with a bonus award, wherein:

(a) a first one of the levels has odds contributing to a generation of the bonus award that vary based on the number of paylines wagered on and do not vary based on the wager per payline, and (b) a second one of the levels has odds contributing to the generation of the bonus award that vary based on the wager per payline and do not vary based on the number of paylines wagered on.

2. The gaming system of claim 1, wherein at least one of the first and second levels of the bonus game includes an odds constant for the bonus award in addition to the varying odds based on the number of paylines wagered on.

3. The gaming system of claim 1, wherein the bonus game includes a third level having constant odds of generating the bonus award.

4. A method of operating a gaming system including at least one input device, at least one display device and at least one processor, the method comprising for a play of a game:

(i) accepting an input of a wager on a number of a plurality of paylines via the at least one input device;

(ii) after accepting the input of the wager, the at least one display device displaying one of a plurality of different combinations of symbols at a plurality of symbol positions associated with a plurality of reels, wherein the plurality of paylines are each associated with a plurality of the reels;

(iii) the at least one processor determining if a designated one of the combinations of symbols has been displayed along one of the paylines, wherein for each payline, odds of generating said designated combination of symbols on said payline vary based on the wager per payline; and (iv) if said designated combination of symbols has been displayed along a wagered on one of the paylines, the at least one processor initiating a bonus game having a plurality of levels and associated with a bonus award, wherein:

(a) a first one of the levels has odds contributing to a generation of the bonus award that vary based on the number of paylines wagered on and do not vary based on the wager per payline, and (b) a second one of the levels has odds contributing to the generation of the bonus award that vary based on the wager per payline and do not vary based on the number of paylines wagered on.

5. The method of claim 4, wherein at least one of the first and second levels of the bonus game includes an odds constant for the bonus award in addition to the varying odds based on the number of paylines wagered on.

6. The method of claim 4, wherein the bonus game includes a third level having constant odds of generating the bonus award.

7. The method of claim 4, which is provided through a data network.

8. The method of claim 7, wherein the data network is an internet.

* * * * *